US012668349B2

(12) United States Patent
Gagné et al.

(10) Patent No.: US 12,668,349 B2
(45) Date of Patent: Jun. 30, 2026

(54) ENHANCED STEERING CONTROL SYSTEM

(71) Applicant: BRP Megatech Industries Inc., Valcourt (CA)

(72) Inventors: Francis Gagné, Saint-Roch-de-Mékinac (CA); Simon Bédard, St-Élie-de-Caxton (CA)

(73) Assignee: BRP Megatech Industries Inc., Valcourt (CA)

( * ) Notice: Subject to any disclaimer, the term of this patent is extended or adjusted under 35 U.S.C. 154(b) by 966 days.

(21) Appl. No.: 17/910,035

(22) PCT Filed: Mar. 9, 2020

(86) PCT No.: PCT/IB2020/052037
§ 371 (c)(1),
(2) Date: Sep. 8, 2022

(87) PCT Pub. No.: WO2021/181134
PCT Pub. Date: Sep. 16, 2021

(65) Prior Publication Data

US 2023/0102262 A1 Mar. 30, 2023

(51) Int. Cl.
*B63H 25/46* (2006.01)
*B63B 34/10* (2020.01)
*B63H 11/107* (2006.01)

(52) U.S. Cl.
CPC ..... *B63H 25/46* (2013.01); *B63B 34/10* (2020.02); *B63H 11/107* (2013.01)

(58) Field of Classification Search
CPC ..... B63H 25/46; B63H 11/107; B63B 34/10
See application file for complete search history.

(56) References Cited

U.S. PATENT DOCUMENTS 6,077,135 A * 6/2000 Ito ..... F02B 61/045 440/83
6,138,596 A * 10/2000 Gonring ..... B63H 25/10 114/144 R (Continued)

FOREIGN PATENT DOCUMENTS

DE 10248343 A1 * 8/2003 ..... B62D 6/008
EP 1268258 B1 6/2008

(Continued)

OTHER PUBLICATIONS

English language abstract for DE 102 48 343 A1 extracted from espacenet.com database on Jul. 1, 2021, 1 page.

(Continued)

*Primary Examiner* — S. Joseph Morano
*Assistant Examiner* — Jovon E Hayes
(74) *Attorney, Agent, or Firm* — BCF LLP

(57) ABSTRACT

Systems, methods, and devices for enhancing steering control of a recreational vehicle. One or more mechanical dampers are coupled to and resist movement of a steering system of the recreational vehicle, and an electrically actuated device is coupled to the steering system for applying torque to the steering system. A sensor is also positioned adjacent the steering system that generates data indicating an operational state of the recreational vehicle. A first torque applied to the steering system by the one or more mechanical dampers is estimated based on the operational state, a second torque to apply to the steering system by the electrically actuated device is calculated based on the estimated first torque and the operational state, and the electrically actuated device is operated to apply the second torque to the steering system.

20 Claims, 9 Drawing Sheets

(56) References Cited

U.S. PATENT DOCUMENTS

| | | | | |
|---|---|---|---|---|
| 6,336,833 | B1 * | 1/2002 | Rheault | B63H 21/21 114/144 R |
| 6,604,479 | B2 * | 8/2003 | McKenney | B63H 25/04 114/151 |
| 6,675,730 | B2 * | 1/2004 | Simard | B63B 34/10 440/43 |
| 7,018,252 | B2 | 3/2006 | Simard et al. | |
| 7,530,345 | B1 * | 5/2009 | Plante | B63B 34/10 123/399 |
| 9,517,826 | B1 * | 12/2016 | Leblond | B63H 11/113 |
| 9,682,757 | B1 * | 6/2017 | Bourret | B63H 11/113 |
| 10,000,269 | B2 | 6/2018 | Burk et al. | |
| 11,254,345 | B2 * | 2/2022 | Zheng | B62D 1/181 |
| 2003/0187558 | A1 * | 10/2003 | Zheng | B62D 6/008 180/443 |
| 2004/0011585 | A1 * | 1/2004 | Menjak | B62D 5/006 180/402 |
| 2004/0029459 | A1 * | 2/2004 | Berthiaume | B63B 34/10 440/1 |
| 2004/0173135 | A1 | 9/2004 | Watanabe et al. | |
| 2005/0199168 | A1 | 9/2005 | Mizutani | |
| 2008/0096445 | A1 | 4/2008 | Nanami | |
| 2008/0119094 | A1 | 5/2008 | Mizutani et al. | |
| 2017/0029085 | A1 | 2/2017 | Burk et al. | |
| 2022/0081095 | A1 * | 3/2022 | Blackburn | B63H 25/46 |

FOREIGN PATENT DOCUMENTS

| | | | |
|---|---|---|---|
| JP | 2011174500 | A | 9/2011 |
| KR | 100702171 | B1 | 3/2007 |
| WO | 2018185528 | A1 | 10/2018 |
| WO | 2020129033 | A1 | 6/2020 |

OTHER PUBLICATIONS

English language abstract for JP 2011-174500 A extracted from espacenet.com database on Jul. 1, 2021, 1 page.

English language abstract for KR 100702171 B1 extracted from espacenet.com database on Jul. 1, 2021, 1 page.

International Search Report for Application No. PCT/IB2019/061319 dated Apr. 2, 2020, 4 pages.

International Search Report for Application No. PCT/IB2020/052037 dated Nov. 12, 2020, 3 pages.

Youtube, "Sea-Doo Fish Pro Review—Long Haul, Ep. 35", Nov. 9, 2018, 3 pages.

* cited by examiner

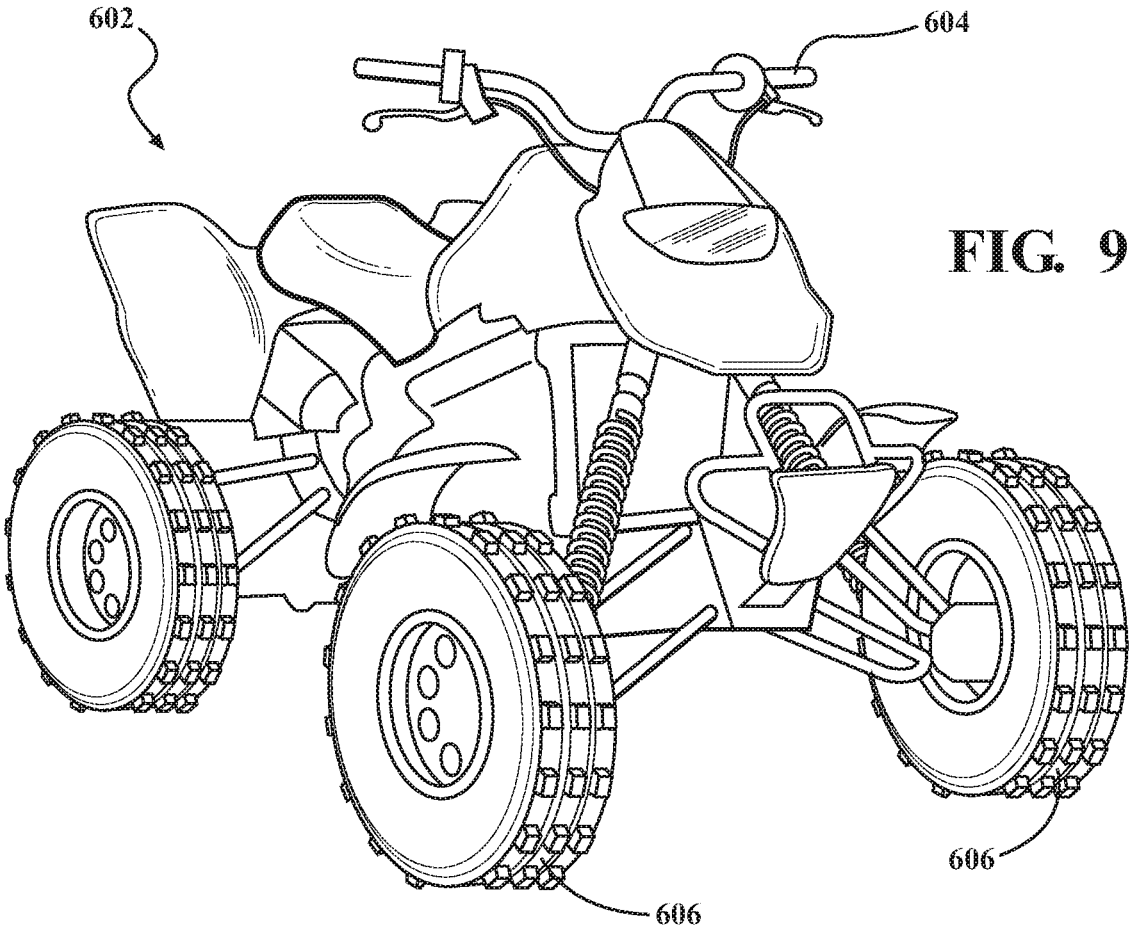
FIG. 9
FIG. 10
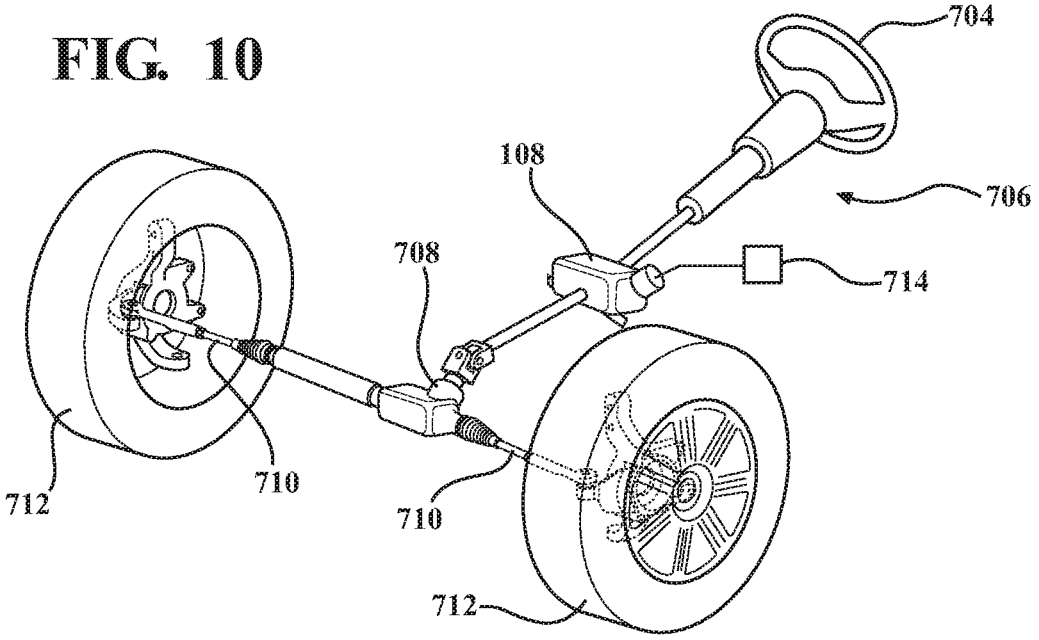

ENHANCED STEERING CONTROL SYSTEM

RELATED APPLICATIONS

This application is a National Stage Entry of International Patent Application No. PCT/IB2020/052037, filed Mar. 9, 2020, the entire disclosure of which is hereby incorporated by reference herein.

BACKGROUND

Some vehicle types, such as personal watercrafts, include steering systems that provide little or no steering feedback to a driver while maneuvering the vehicle. The driver, who may be accustomed to the relatively high steering feedback provided by a typical automobile, may associate the lack of feedback with a lack of control. This perceived lack of control may cause the driver to panic and perform dangerous maneuvers, such as oversteering at high speeds.

SUMMARY

In one example, a recreational vehicle includes a steering system for turning the recreational vehicle, one or more mechanical dampers coupled to the steering system that resist rotation of the steering system, and an enhanced steering control system coupled to the steering system. The enhanced steering control system includes an electrically actuated device coupled to the steering system for applying torque to the steering system, a sensor positioned adjacent the steering system that generates data indicating an operational state of the recreational vehicle, and a controller coupled to the electrically actuated device and the sensor. The controller is configured to estimate a first torque applied to the steering system by the one or more mechanical dampers based on the operational state, calculate a second torque to apply to the steering system by the electrically actuated device based on the estimated first torque and the operational state, and operate the electrically actuated device to apply the second torque to the steering system.

In another example, an enhanced steering control system for a steering system of a recreational vehicle including one or more mechanical dampers coupled to the steering system that resist movement of the steering system includes an electrically actuated device adapted to be coupled to the steering system for applying force to the steering system, a sensor adapted to be positioned adjacent the steering system when the electrically actuated device is coupled to the steering system that generates data indicating an operational state of the recreational vehicle, and a controller coupled to the electrically actuated device and the sensor. The controller is configured to estimate a first torque applied to the steering system by the one or more mechanical dampers based on the operational state, calculate a second torque to apply to the steering system by the electrically actuated device based on the estimated first torque and the operational state, and operate the electrically actuated device to apply the second torque to the steering system.

In a further example, a method for enhancing steering of a recreational vehicle including a steering system, one or more mechanical dampers coupled to and that resist movement of the steering system, an electrically actuated device coupled to the steering system for applying torque to the steering system, and a sensor positioned adjacent the steering system that generates data indicating an operational state of the recreational vehicle, includes estimating a first torque applied to the steering system of the recreational vehicle by the one or more mechanical dampers based on the operational state of the recreational vehicle, calculating a second torque to apply to the steering system of the recreational vehicle by the electrically actuated device based on the estimated first torque and the operational state of the recreational vehicle, and operating the electrically actuated device to apply the second torque to the steering system of the recreational vehicle.

BRIEF DESCRIPTION OF THE DRAWINGS

FIG. 9 is a perspective view of an all-terrain vehicle (ATV) type recreational vehicle that may incorporate the enhanced steering control system of FIG. 1.

FIG. 10 is a perspective view of a steering assembly of a recreational vehicle that may incorporate the enhanced steering control system of FIG. 1.

DETAILED DESCRIPTION

The unique steering dynamics and intense environmental conditions of recreational vehicles can provide a driving feel that is quite different from that of the typical automobile. For instance, typical personal watercraft (PWC) type recreational vehicles have steering dynamics that provide little or no feedback to the driver and deliver tremendous cornering forces at high speeds via very light steering effort. Specifically, the steering system of the typical PWC provides little or no feedback to the driver of the forces exchanged between the PWC and its environment, such as during a turn. The steering handle of the typical PWC also has less than a ninety-degree lock-to-lock range, which offers very quick but low-resolution steering control. Conversely, the drivetrain of a typical automobile provides relatively high steering feedback to the driver, and includes a steering wheel having a multi-turn (e.g., three turns) lock-to-lock range, which offers high resolution steering control at the expense of increased driver effort to generate high steering rates.

An unexperienced driver of the typical PWC, who may be used to the driving feel of an automobile, may associate the lack of steering feedback and ease of steering provided by the PWC with a lack of responsiveness or control. This association may lead the driver to perform dangerous maneuvers, such as excessive steering operations at high speeds that eject the driver from the PWC. To provide increased steering feedback and discourage dangerous maneuvers, recreational vehicles like the PWC may be equipped with an enhanced steering control system described herein.

Figure 1:
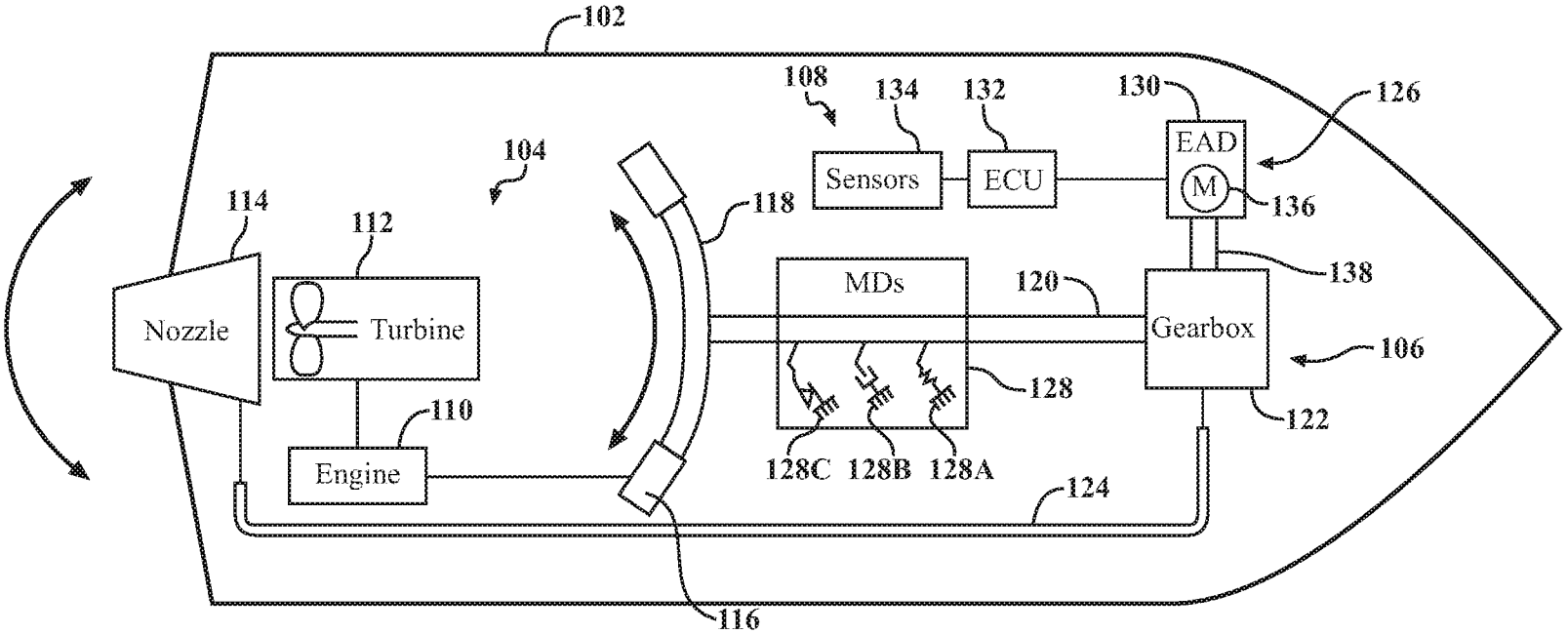
FIG. 1 is a schematic diagram of a personal watercraft type recreational vehicle having an enhanced steering control system.

FIG. 1 illustrates a personal watercraft (PWC) 102 with an enhanced steering control system 108 that may be configured to provide increased steering feedback to a driver. As described in more detail below, the enhanced steering control system may utilize a combination of one or more mechanical dampers 128 and an electrically actuated device (EAD) 130 to apply torque to the steering system of the PWC 102 as a function of the operational state the PWC 102, and thereby provide increased steering feedback to the driver. Although the EAD 130 may be implemented alone to apply the increased steering feedback, utilizing the EAD 130 in combination with mechanical dampers 128 may reduce the needed size of the EAD 130, and may reduce the electrical load required to provide the desired steering feedback.

The PWC 102 may include a jet powered propulsion system 104, a steering system 106, and the enhanced steering control system 108. The jet powered propulsion system 104 may be configured to propel the PWC 102 in a forward direction. The steering system 106 may be coupled to the jet powered propulsion system 104, and may be configured to adjust the angle of the jet powered propulsion system 104 relative to the hull of the PWC 102 to steer the PWC 102 in a given direction. The enhanced steering control system 108 may be coupled to the steering system 106, and may be configured to implement enhanced steering control for the PWC 102.

The jet powered propulsion system 104 may include an engine 110, a turbine 112, a nozzle 114, and a throttle 116. The throttle 116 may be connected to a steering handle 118 of the PWC 102, and may be coupled to the turbine 112, such as via the engine 110. A driver may actuate with the throttle 116 to cause the engine 110 to rotate the turbine 112. Acceleration of the PWC 102 may correspond to the rotational speed of the turbine 112, which may correspond to the extent of actuation of the throttle 116 by the driver. For instance, the throttle 116 may form a rotatable grip secured to an end the steering handle 118. The greater the rotation of the throttle 116, the faster the engine 110 may rotate the turbine 112, and the faster the turbine 112 may propel the PWC 102 in the forward direction.

Rotation of the turbine 112 may drive water into an input end of the nozzle 114. The nozzle 114 may responsively form a hydraulic jet stream that is expressed away from the PWC 102 through an output end of the nozzle 114. The jet stream may function to propel the PWC 102 in the forward direction. When the nozzle 114 expresses a jet stream in a direction parallel and/or collinear to a longitudinal axis of the PWC 102 (i.e., the axis extending through the center of the stern and bow of the PWC 102), the jet stream may propel the PWC 102 in a straight forward direction.

The steering system 106 may include the steering handle 118, a steering column 120, a gearbox 122, and a push-pull cable 124. Rotation of the steering handle 118 left and right may cause the PWC 102 to turn left and right respectively. Specifically, the steering handle 118 may be coupled to the gearbox 122 via the steering column 120. Rotation of the steering handle 118 by a driver may cause a corresponding rotation of the steering column 120, which may be received by the gearbox 122. The gearbox 122 may be coupled to the nozzle 114 via the push-pull cable 124, and may be configured to translate a rotation of the steering column 120, such as via one or more gears, into a push or pull force onto an end of the push-pull cable 124 connected to the gearbox 122. Responsive to the push or pull force being applied to the connected end of the push-pull cable 124, the other end of the push-pull cable 124 may exert a respective push or pull force onto the nozzle 114. The push or pull force applied to the nozzle 114 may cause the output end of the nozzle 114 to pivot with respect to the longitudinal axis of the PWC 102. In alternative examples, rather than the gearbox 122, the PWC 102 may include a different mechanism, such as an armlink or an electronic actuator, between the steering handle 118 and the nozzle 114 that is configured to translate a rotation of the steering handle 118 into a pivoting steering force applied to the nozzle 114.

Setting the nozzle 114 at a non-parallel angle to the longitudinal axis of the PWC 102, which may correspondingly set the jet stream at a non-parallel angle to the longitudinal axis, may cause the PWC 102 to turn in a direction corresponding to the direction of the jet stream. Specifically, as the output end of the nozzle 114 pivots away from the longitudinal axis of the PWC 102 responsive to a rotation of the steering handle 118 to perform a turn, the jet stream formed by the nozzle 114 may cause the hull of the PWC 102 to lean towards the turn. The hull's geometry, which may include ridges or other fixed control surfaces, may correspondingly interact with the water on the inside the turn. This interaction may effect turning the PWC 102 under the power of the jet stream.

For instance, a clockwise rotation of the steering handle 118 may cause a corresponding clockwise rotation of the steering column 120. The gearbox 122 may be configured to translate the clockwise rotation of the steering column 120 into a pull force on the push-pull cable 124, which may responsively exert a pull force on the nozzle 114. This pull force may cause the output end of the nozzle 114 to pivot right (or counter-clockwise), thereby causing the jet stream to push the back end of the PWC 102 left and effect a right turn of the PWC 102. Similarly, a counter-clockwise rotation of the steering handle 118 may cause a corresponding counter-clockwise rotation of the steering column 120. The gearbox 122 may be configured to translate this counter-clockwise rotation of the steering column 120 into a push force on the push-pull cable 124, which may responsively exert a push force on the nozzle 114. This push force may cause the output end of the nozzle 114 to pivot left (clockwise), thereby causing the jet stream to push the back end of the PWC 102 right and effect a left turn of the PWC 102.

The enhanced steering control system 108 may be coupled to the steering system 106 of the PWC 102, and may be configured to increase steering feedback felt by the driver during operation of the PWC 102. The steering control system 108 may include an electronic control system 126 and one or more mechanical dampers (MDs) 128. The electronic control system 126 may include an electrically actuated device (EAD) 130, an electronic control unit (ECU) 132, and one or more sensors 134.

The EAD 130 may be coupled to the steering system 106 and the ECU 132, and may operate as an electric power steering (EPS) unit for the PWC 102. Specifically, the EAD 130 may be configured, such as at the direction of the ECU 132, to apply force to the steering system 106. The applied force may increase steering feedback felt by the driver during operation of the PWC 102.

The EAD 130 may include a motor 136, such as an electric motor, for applying the force to the steering system 106. The motor 136 may be coupled to the steering column 120, such as through the gearbox 122 and via a motor shaft 138 rotatable by the motor 136. During operation of the PWC 102, the gearbox 122 may receive rotations of the motor shaft 138 by the motor 136, and may be configured to translate these rotations into corresponding forces applied to the steering system 106. For instance, the gearbox 122 may be configured to translate the rotation of the motor shaft 138 into a torque applied to the steering handle 118 and the steering column 120, and correspondingly into a push or pull force applied to the push-pull cable 124 and nozzle 114. In one example, the applied forces may resist rotation of the steering handle 118 by the driver.

Rather than applying force to the steering system 106 through the gearbox 122, the EAD 130 may be coupled to and apply the torque to the steering column 120 directly. For instance, the EAD 130 may include one or more arms coupled to the steering column 120 that are rotatable by the motor 136 to apply torque to the steering column 120, may include a sleeve through which the steering column 120 extends and is coupled to that is rotatable by the motor 136 to apply torque to the steering column 120, may include a belt that wraps around the steering column 120 and is rotatable by the motor 136 to apply torque to the steering column 120, or may include a gear that interacts with a corresponding geared portion of the steering column 120 and is rotatable by the motor 136 to apply torque to the steering column 120.

The ECU 132 (also referred to herein as a "controller") may be configured to communicate with other components of the PWC 102, or more particularly with other components of the electronic control system 126, directly and/or over one or more networks, such as a control area network (CAN), and through wired and/or wireless connections. During operation of the PWC 102, the ECU 132 may be configured to operate the EAD 130 to apply force to the steering system 106 based on data received from the sensors 134. Additional details of the configuration of the ECU 132 are provided below.

The one or more sensors 134 may be configured to generate data (also referred to herein as "sensor data") indicating the current operational state of the PWC 102. At least one of the sensors 134 may be positioned adjacent the steering system 106, and may be configured to generate sensor data indicating the current operational state of the steering system 106.

For instance, the sensors 134 may include a steering angle sensor positioned adjacent the steering system 106 and configured to generate sensor data indicating a current angle of the steering system 106, or more particularly of the steering handle 118 and/or nozzle 114, such as relative to a center position of the steering system 106 (e.g., a position in which the nozzle 114 and jet stream are parallel with the longitudinal axis of the PWC 102). A steering angle of zero may correspond to the steering system 106 being located at its center position, a positive steering angle may correspond to the steering system 106 being off-center in one direction (e.g., clockwise direction), and a negative angle may correspond to the steering system 106 being off-center in the other direction (e.g., counterclockwise direction). The magnitude of the steering angle may represent the difference between the current angle of the steering system 106 and its center position.

The sensor data generated by the steering angle sensor may also indicate the steering rate of the steering system 106. Specifically, the ECU 132 may be configured to track the steering angle of the steering system 106 indicated by the steering angle sensor over time, and to determine the rate and direction that the steering system 106, or more particularly the steering handle 118 and steering column 120, is being rotated based thereon. The magnitude of the steering rate may correspond to the speed of rotation, and the sign of the steering rate may correspond to the direction of rotation. For instance, the ECU 132 may be configured to indicate a positive steering rate when the steering angle sensor data indicates rotation of the steering handle 118 in the clockwise direction, and indicate a negative steering rate when the steering rate sensor data indicates rotation of the steering handle 118 in the counterclockwise direction.

The sensors 134 may also include a torque sensor positioned adjacent the steering system 106 and configured to generate sensor data indicating a magnitude and direction of torque on the steering system 106, or more particularly on the steering column 120 and the steering handle 118. The sensors 134 may further include a rotation sensor configured to generate sensor data indicating the current rotational speed of the engine 110 and/or turbine 112, a throttle request sensor configured to generate sensor data indicating an extent to which the driver is currently actuating the throttle 116, which may be represented by a numerical value that increases with increased actuation of the throttle 116, and a speed sensor configured to generate sensor data indicating the current speed of the PWC 102. The sensors 134 may additionally include a navigation system, which may include a global positioning system (GPS) and/or an inertial measurement system (IMS), configured to generate sensor data indicating a current position of the of the PWC 102.

The sensor data generated by the above sensors 134 may indicate the current velocity (e.g., speed and heading) and acceleration level of the PWC 102. For instance, the ECU 132 may be configured to determine the current velocity and acceleration level of the PWC 102 based on speeds generated by the speed sensor over time, and/or based on positions of the PWC 102 generated by the navigation system over time. The ECU 132 may further be configured to determine the current acceleration level of the PWC 102 based on a current speed of the PWC 102 generated by the speed sensor, and a current rotational speed of the engine 110 and/or turbine 112 generated by the rotational sensor or a throttle request extent of indicated by the throttle request sensor. For instance, the ECU 132 may be configured to determine an acceleration level of the PWC 102 based on these operational parameter values by applying the values to a stored look-up table that associates varying possible operational states each setting forth possible values for these operational parameters with different acceleration levels.

The one or more mechanical dampers 128 may be coupled to the steering system 106, such as to the steering column 120, and may be configured to provide increased steering feedback during movement of the steering system 106. Specifically, the one or more mechanical dampers 128 may be configured to resist movement of the steering system 106, or more particularly rotation of the steering handle 118 and the steering column 120, such as to necessitate increased effort to change the angle of the steering system 106 of the PWC 102. At least one of the mechanical dampers 128 may be configured to resist movement of the steering system 106 from its center position, and at least one of the mechanical dampers 128 may be configured to resist movement of the steering system 106 towards the center position. At least one of the mechanical dampers 128 may also be configured to bias the steering system 106 towards the center position, such as to provide a self-centering function. The one or more mechanical dampers 128 may thus facilitate providing a driving feel that is closer to that of a typical automobile.

For example and without limitation, the one or more mechanical dampers 128 may include a spring type mechanical damper 128A, a fluid type mechanical damper 128B, and/or a friction type mechanical damper 128C. The spring type mechanical damper 128A may include a spring that compresses with movement of the steering system 106 from the center position, and decompresses with movement of the steering system 106 to the center position. The torque applied by the spring type mechanical damper 128A to the steering system 106 may be a function of the angle of the steering system 106. Specifically, the spring type mechanical damper 128A may be configured to apply increased torque in the direction of the center position of the steering system 106 as the steering handle 118 rotates further from the center position, and to apply decreased torque in the direction of the center position of the steering system 106 as the steering handle 118 rotates towards the center position. The spring type mechanical damper 128A may also bias the steering system 106 to the center position, such as to provide a self-centering function when the driver is providing little or no torque to the steering handle 118.

The fluid type mechanical damper 128B may include a plunger configured to push fluid between fluid chambers with movement of the steering system 106, where the fluid resists movement of the plunger. The torque applied by the fluid type mechanical damper 128B to the steering system 106 may be a function of the steering rate of the steering system 106. Specifically, the fluid type mechanical damper 128B may apply increased torque to the steering system 106 in a direction opposite the direction of rotation of the steering handle 118 as the steering rate of the steering system 106 increases. In some instances, the fluid type mechanical damper 128B may be a magnetorheological (MR) fluid damper in which a varying magnetic field is applied to MR fluid contained in the chambers that alters the viscosity of the fluid and correspondingly adjusts the dampening response provided by the damper.

The friction type mechanical damper 128C may include a friction disc configured to resist rotation with movement of the steering system 106. The torque applied by the friction type mechanical damper 128C to the steering system 106 may be a function of the steering rate of the steering system 106. Specifically, the friction type mechanical damper 128C may apply increased torque to the steering system 106 in a direction opposite the direction of rotation of the steering handle 118 as the steering rate of the steering system 106 increases.

The ECU 132 may be configured to operate the EAD 130 to apply force to the steering system 106 based on an estimation of the force applied to the steering system 106 by mechanical dampers 128. Specifically, the ECU 132 may be configured to determine a target force for the enhanced steering control system 108 to apply the steering system 106 based on the sensor data, to estimate the force being applied to the steering system 106 by the mechanical dampers 128 based on the sensor data, and to operate the EAD 130 to apply additional force to the steering system 106 that minimizes a difference between the force applied to the steering system 106 by the enhanced steering control system 108 and the target force based on the estimated force. Depending on the current operational state of the PWC 102 indicated by the sensor data, the ECU 132 may operate the EAD 130 to apply force to the steering system 106 that is in a same or opposite direction as the force being applied by the mechanical dampers 128 to acheive the target force. In either case, the force applied by the EAD 130 may supplement that applied by the mechanical dampers 128 to effect a target force being applied the steering system 106, which may enable the size and power consumption of the EAD 130 to be reduced relative to if the enhanced steering control system 108 was implemented without the mechanical dampers 128.

Figure 2:
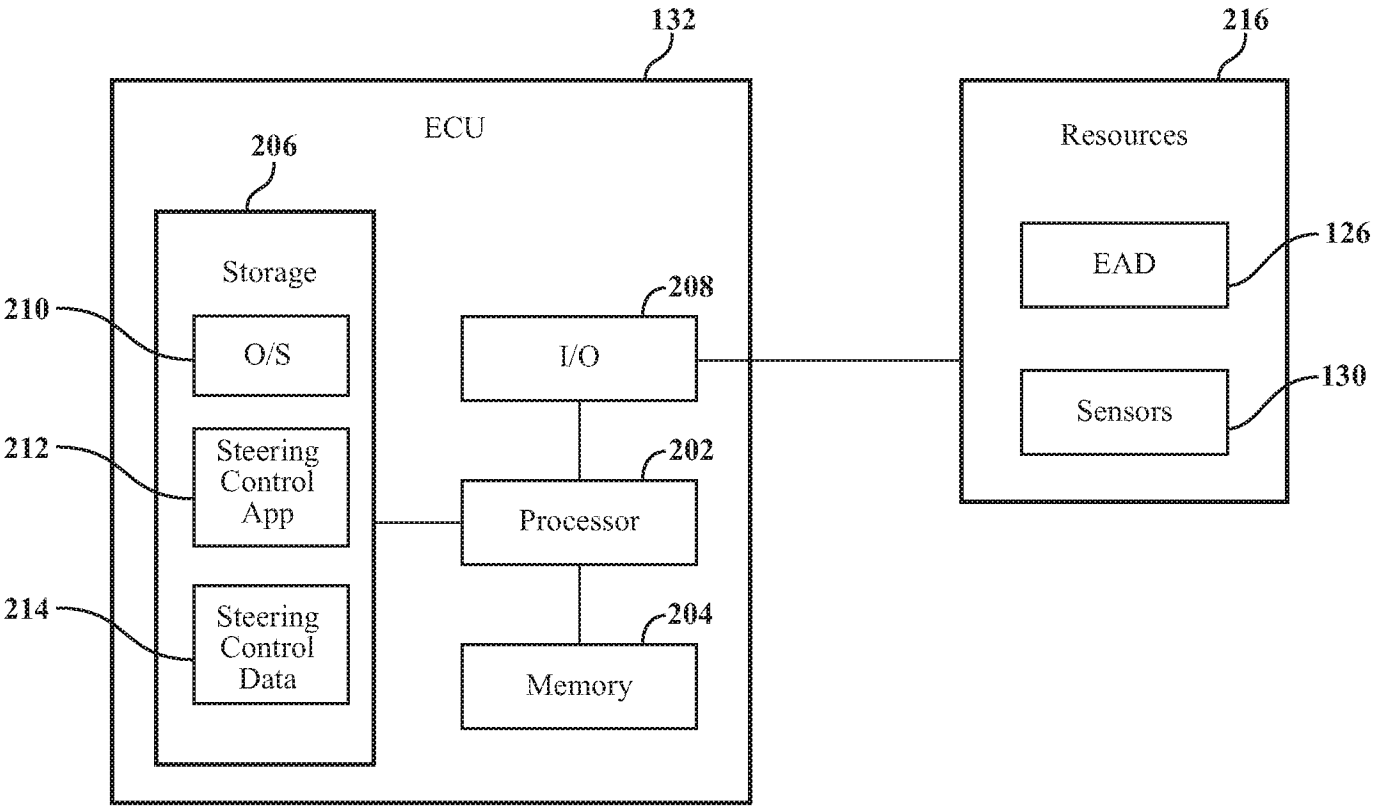
FIG. 2 is a schematic diagram of a controller that may be incorporated in a recreational vehicle to provide enhanced steering control.

Referring to FIG. 2, the ECU 132 may include a processor 202, memory 204, non-volatile storage 206, and an input/output (I/O) interface 208. The processor 202 may include one or more devices selected from microprocessors, microcontrollers, digital signal processors, microcomputers, central processing units, field programmable gate arrays, programmable logic devices, state machines, logic circuits, analog circuits, digital circuits, or any other devices that manipulate signals (analog or digital) based on operational instructions read from the non-volatile storage 206 and stored in memory 204. The memory 204 may include a single memory device or a plurality of memory devices including, but not limited, to read-only memory (ROM), random access memory (RAM), volatile memory, non-volatile memory, static random access memory (SRAM), dynamic random access memory (DRAM), flash memory, cache memory, or any other device capable of storing information. The non-volatile storage 206 may include one or more persistent mass data storage devices such as a hard drive, optical drive, tape drive, non-volatile solid-state device, or any other device capable of persistently storing information.

The processor 202 may be configured to implement the functions, features, modules, processes, and methods of the ECU 132 described herein. In particular, the processor 202 may operate under control of software, such as an operating system 210 and a steering control application 212, embodied by computer-executable instructions residing in the non-volatile storage 206. The computer-executable instructions may be compiled or interpreted from a variety of programming languages and/or technologies, including, without limitation, and either alone or in combination, Java, C, C++, C#, Objective C, Fortran, Pascal, Java Script, Python, Perl, and PL/SQL. The processor 202 may be configured to execute the software by being configured to read into memory 204 and execute the computer-executable instructions embodying the software residing in the non-volatile storage 206. The computer-executable instructions may be configured, upon execution of the processor 202, to cause the processor 202 to implement the functions, features, modules, processes, and methods of the ECU 132 described herein. In this way, the software may be configured to implement the functions, feature, modules, processes, and methods of the ECU 132 described herein.

For example, the operating system 210 may be configured to manage computer resources so that the steering control application 212 may be executed by the processor 202. Alternatively, the processor 202 may execute the steering control application 212 directly, in which case the operating system 210 may be omitted. The steering control application 212 may be configured to implement enhanced steering control for the PWC 102 by being configured to determine a target force for the enhanced steering control system 108 to apply the steering system 106 based on the sensor data, estimate the force applied to the steering system 106 by the mechanical dampers 128 based on the sensor data, and to operate the EAD 130 to apply additional force to the steering system 106 that minimizes a difference between the force applied to the steering system 106 by the enhanced steering system 106 and the target force based on the estimated force. Further details regarding these operations are provided below.

The non-volatile storage 206 may also include data, such as steering control data 214, supporting the functions, features, modules, processes, and methods of the ECU 132 described herein. The software of the ECU 132, such as the steering control application 212, may be configured to access this data during execution. For instance, the steering control data 214 may include data modeling operation of the mechanical dampers 128 as a function of the operational state of the PWC 102, data defining target forces for the enhanced steering control system 108 to apply to the steering system 106 as a function of the operational state of the PWC 102, and data defining forces applied by the EAD 130 to the steering system 106 as a function of electrical current supplied to the motor 136. The steering control application 212 may thus be configured to access the steering control data 214 to determine a target force for enhanced steering control system 108 to apply the steering system 106 based on the sensor data, estimate the force applied to the steering system 106 by the mechanical dampers 128 based on the sensor data, and to operate the EAD 130 to apply the additional force to the steering system 106.

The ECU 132 may be operatively coupled to one or more external resources 216 via the I/O interface 208. The I/O interface 208 may include one or more wireless interfaces such as Wi-Fi and Bluetooth, and may include one or more wired interfaces such as Ethernet and CAN. The external resources 216 may include one or more other components of the PWC 102, such as the EAD 130 and the sensors 134.

While an exemplary PWC 102 is illustrated in FIGS. 1 and 2, the example is not intended to be limiting. Indeed, the PWC 102 may have more or fewer components, and alternative components and/or implementations may be used. For instance, the described functions of two or more of the above-described components may be combined and implemented by a single component, and the described functions of one of the above-described components may be implemented across several components. As an example, the illustrated ECU 132 may be implemented by multiple ECUs that are configured to cooperatively implement the functionality of the ECU 132 described herein.

Figure 3:
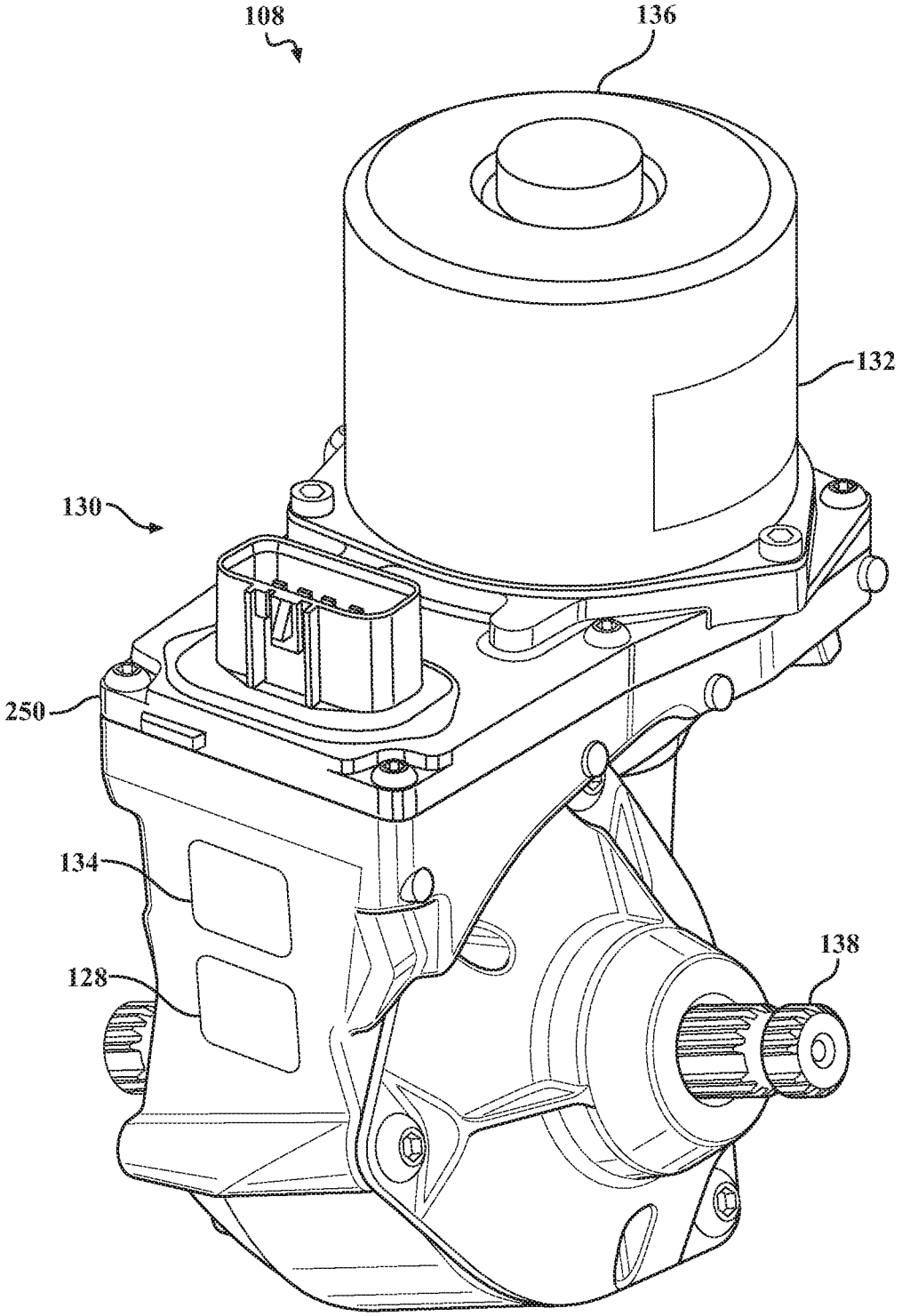
FIG. 3. is a perspective view of an enhanced steering control system that may be coupled to the steering system of a recreational vehicle to provide enhanced steering control.

FIG. 3 illustrates an example of the enhanced steering control system 108. As shown in the illustrated example, the enhanced steering control system 108 may be provided as a single unit or device adapted to be coupled to the steering system 106. Specifically, the enhanced steering control system 108 may include a housing 250 encompassing the EAD 130, ECU 132, one or more of the sensors 134, mechanical dampers 128, and a portion of the motor shaft 138. The motor shaft 138 may extend from the housing 150 and be adapted to be coupled to the steering column 120, either directly or through the gearbox 122. The one or more of the sensors 134 may be arranged within the housing 250 adjacent the motor shaft 138 so as to generate the above-described sensor data based on rotation of the motor shaft 138, which may correspond to the rotation of the steering system 106. The mechanical dampers 128 may also be arranged within the housing 250 so as to be adjacent and coupled to the motor shaft 138. During operation of the PWC 102, the mechanical dampers 128 may apply force to the steering system 106 as described above by applying corresponding force to the motor shaft 138, which may be coupled to and rotate with the steering system 106.

Figure 4:
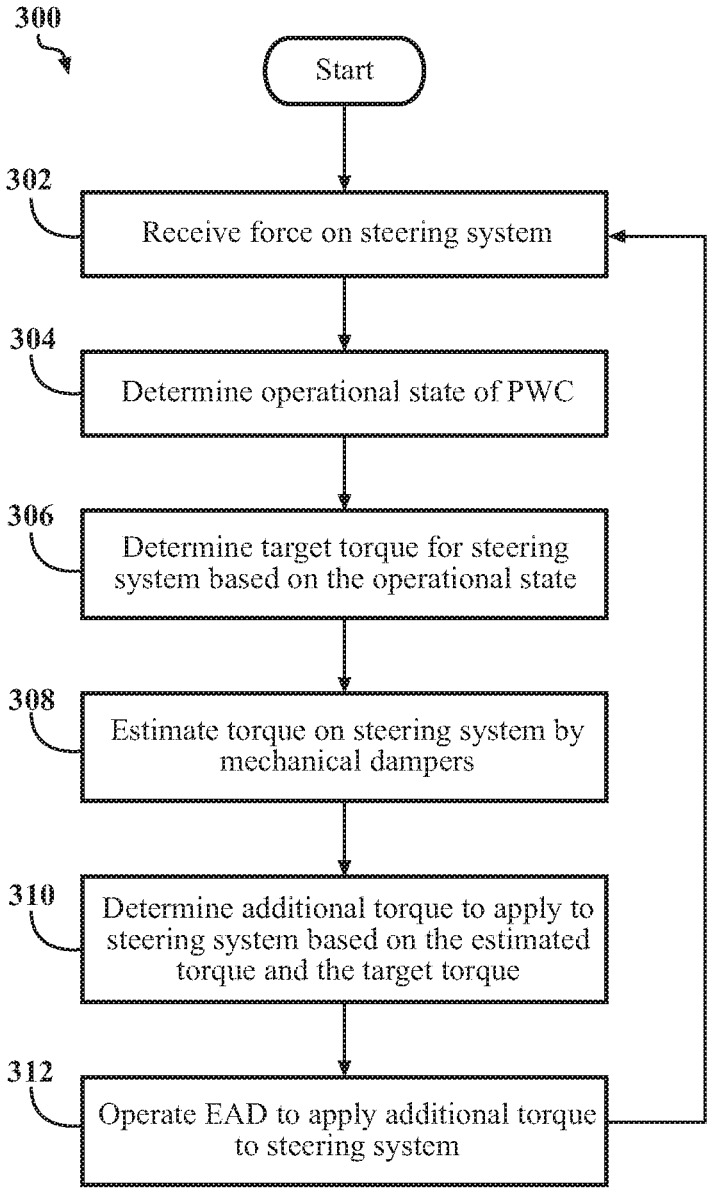
FIG. 4 is a flowchart of a method for providing a recreational vehicle with enhanced steering control.

FIG. 4 illustrates a method 300 for implementing enhanced steering control in a recreational vehicle such as a PWC 102. The ECU 132 may be configured to perform or implement the method 300, such as via execution of the steering control application 212.

In block 302, a force may be received by the steering system 106. For instance, a driver may rotate the steering handle 118 and thereby apply a torque to the steering system 106, or more particularly to the steering column 120, such as to effect a turn. Environmental conditions may also place a torque on the steering system 106. For instance, large waves and high speed winds may cause movement of the nozzle 114, which may correspondingly apply a torque to the steering column 120 and the steering handle 118.

In block 304, a current operational state of the PWC 102 may be determined, such as based on the sensor data generated by the one or more sensors 134. The ECU 132 may be configured to determine the current operational state of the PWC 102, which may be defined by values for one or more operational parameters of the PWC 102, based on the sensor data. For instance, the ECU 132 may be configured to determine a current angle of the steering system 106 based on the sensor data generated by the steering angle sensor, as described above. The ECU 132 may also be configured to determine a current steering rate of the steering system 106 based on the sensor data as described above. In some examples, the angle of the steering system 106 and the steering rate may be the only operational parameters defining the operational state of the PWC 102 determined by the ECU 132 in block 304.

Alternatively, one or more other operational parameters may also or instead define the operational state of the PWC 102 determined by the ECU 132 in block 304. For instance, the ECU 132 may be configured to determine a current torque on the steering system 106 based on sensor data generated by the steering torque sensor, a current rotational speed of the engine 110 and/or turbine 112 based on sensor data generated by the rotation sensor, a current extent of throttle actuation based on sensor data generated by the throttle request sensor, a current speed of the PWC 102 based on sensor data generated by the speed sensor or navigation system, a current position of the PWC 102 based on sensor data generated by the navigation system, a current heading of the PWC 102 based on sensor data generated by the navigation system, and/or a current acceleration level of the PWC 102 based on sensor data generated by the one or more of the sensors 134 as described above. The ECU 132 may thus be configured to determine the current operational state of the of the PWC 102 from the sensor data by being configured to determine values for one or more of the above operational parameters, the current angle of the steering system 106, and/or the current steering rate of the steering system 106.

In block 306, a target torque for the steering system 106 may be determined based on the operational state of the PWC 102. The target torque may be a torque desired to be applied to the steering system 106 by the enhanced steering control system 108, or more particularly by the mechanical dampers 128 and the EAD 130, to provide the PWC 102 with enhanced steering control. The direction of the target torque may depend on the enhanced steering control function being provided. The ECU 132 may be configured to determine the target torque based on the determined operational state of the PWC 102 and the steering control data 214. The steering control data 214 may include data associating varying possible operational states with different target torques in accordance with desired enhanced steering controls, such as through one or more formulas and/or lookup tables defined by the steering control data 214.

As an example, for each of one or more of the operational parameters defining the current operational state of the PWC 102, the steering control data 214 may associate varying possible values for the operational parameter with different torque values. Given a current operational state of the PWC 102 including a particular value for each of these one or more operational parameters, the ECU 132 may be configured to determine the target torque by being configured to determine the torque value associated with each particular value in the steering control data 214, to determine a base torque for the enhanced steering control system 108 based on each determined torque value, and to then determine the target torque based on the base torque. If there is only one determined torque value, then the ECU 132 may be configured to use this torque value as the base torque. If there is more than one determined torque value, then the ECU 132 may be configured to determine the base torque by summing the determined torque values, multiplying the magnitudes of the determined torque values, determining an average of the determined torque values, or using the determined torque value with the highest magnitude as the base torque. In some examples, the ECU 132 may be configured to use the determined base torque as the target torque determined in block 306.

Alternatively, for each of one or more operational parameters defining the operational state of the PWC 102, the steering control data 214 may also associate varying possible values for the operational parameter with different weight values. Given a current operational state of the PWC 102 including a particular value for each of these one or more operational parameters, the ECU 132 may be configured to determine the weight value associated with each particular value in the steering control data 214, to determine a base weight for the enhanced steering control system 108 based on each determined weight value, and to then determine the target torque based on the base weight and the base torque described above. If there is only one determined weight value, then the ECU 132 may be configured to use this weight value as the base weight. If there is more than one determined weight value, then the ECU 132 may be configured to determine the base weight by summing the determined weight values, multiplying the magnitudes of the determined torque values, determining an average of the determined weight values, or using the highest determined weight value as the base weight. The ECU 132 may be configured to determine the target torque by multiplying the base weight by the base torque. The one or more operational parameters associated with torque values in the steering control data 214 may differ from the one or more operational parameters associated with weight values in the steering control data 214.

As a further alternative, the ECU 132 may be configured to determine the target torque in block 306 by directly multiplying the determined base torque described above by the current value for one or more of the operational parameters defining the current operational state of the PWC 102. The one or more operational parameters associated with torque values in the steering control data 214 and contributing to the base torque may differ from the one or more operational parameters being directly multiplied. For instance, the current operational state of the PWC 102 may include a current angle of the steering system 106 and a current steering rate of the steering system 106. In this case, the ECU 132 may be configured to determine the target torque in block 306 by determining the torque value associated with the current angle of the steering system 106 in the steering control data 214 as the base torque, and multiplying this base torque by the current steering rate of the steering system 106 to determine the target torque. The target torque may thus be proportional to the current steering rate of the steering system 106.

The steering control data 214 may include a lookup table for an operational parameter defining the current operational state of the PWC 102 that omits an entry associating the current value for the operational parameter with a torque value or weight value. In this case, the ECU 132 may be configured to interpolate such an entry from two or more entries of the lookup table closest to the current value for the operational parameter. For instance, the ECU 132 may be configured to use linear interpolation to determine the missing entry. In some examples, the steering control data 214 may include at least one multi-dimensional lookup table associating varying possible combinations of values for operational parameters defining the operational state of the PWC 102 with different torque values or weight values. In this case, the ECU 132 may be configured to input the current values for these operational parameters into the lookup table to determine the torque value or weight value associated with the current values, and then determine the target torque as described above. The ECU 132 may be configured to similarly use multi-dimensional interpolation, such as multi-dimensional linear interpolation, to determine a torque value or weight value for a combination of current values omitted from the lookup table.

In one example, the determined target torque may be configured to resist rotation of the steering system 106, or more particularly of the steering handle 118, to provide increased steering feedback to the driver based on the current operational state of the PWC 102 and prevent intense environmental conditions from adjusting the angle of the steering system 106. For instance, the current operational state of the PWC 102 may include a current steering angle and/or a current steering rate of the steering system 106. The ECU 132 may be configured to determine a target torque that resists rotation of the steering system 106 based on the current steering angle and/or steering rate and the steering control data 214. Specifically, the steering control data 214 may associate possible steering angles each with a different torque value, and/or may associated possible steering rates each with a different torque value or weight value. The ECU 132 may be configured to determine the target torque by determining the torque value associated with the current steering angle in the steering control data 214 and/or determining the torque value or weight value associated with the current steering rate of the steering system 106 in the steering control data 214, and then determining the target torque based on each determined torque value and/or weight value as described above.

The steering control data 214 may be configured such that the greater the possible steering angle, the greater the magnitude of the torque value associated with the steering angle, and/or the greater the possible steering rate, the greater the magnitude of the torque value or weight value associated with the possible steering rate. Consequently, the greater the steering angle and/or steering rate, the greater the magnitude target torque. The determined target torque may include a direction towards the center position of the steering system 106, or may include a direction opposite the direction of rotation of the steering system 106, which may be indicated by the sign of the steering rate as described above.

The ECU 132 may further be configured to determine a target torque for resisting rotation of the steering system 106 based on additional operational parameters, such as the current speed, engine RPM value, throttle request extent, and/or acceleration level indicated in the current operational state of the PWC 102. For instance, the steering control data 214 may associate possible speeds, possible engine RPM values, possible throttle request extents and/or acceleration levels each with a different weight value. The ECU 132 may be configured to determine the target torque that resists rotation of the steering system 106 by determining the weight value associated with the current speed, engine RPM value, and/or throttle request value of the PWC 102 in the steering control data 214, and determining the target torque based on each determined weight value and the base torque as described above. The steering control data 214 may be configured such that the greater the possible value for each of the speed, engine RPM, throttle request extent, and/or acceleration level parameters, the greater the weight value associated with the possible value. Consequently, the greater the speed, engine RPM value, throttle request extent and/or acceleration level of the PWC 102, the greater the target torque. In some instances, the ECU 132 may be configured to determine the target torque by multiplying the determined base torque by the current speed, engine RPM value, throttle request extent and/or acceleration level.

The determined target torque may also be configured to provide a self-centering function for the steering system 106. For instance, the current operational state of the PWC 102 may include a current steering angle and a current steering rate of the PWC 102, and the ECU 132 may be configured to determine a target torque providing a self-centering function based on the current steering angle, the current steering rate, and the steering control data 214. Specifically, the ECU 132 may be configured to determine whether the current steering rate is less than a defined threshold, indicating the steering system 106 is not in substantial motion. Responsive to determining that the current steering rate is less than the defined threshold, the ECU 132 may be configured to determine a difference between the current steering angle of the steering system 106 and the center position for the steering system 106. The steering control data 214 may associate possible differences between the steering angle and center position of the steering system 106 each with a different torque value for minimizing the difference. The ECU 132 may be configured to determine the target torque by determining the torque value associated with the determined difference in the steering control data 214, and using the determined torque value, which may also be set as the base torque described above, as the target torque. The steering control data 214 may be configured such that the greater the possible difference, the greater the magnitude of the torque value associated with the possible difference so as to provide fast centering while minimizing steering overshoots. The determined target torque may include a direction towards the center position of the steering system 106.

The ECU 132 may further be configured to determine a target torque for centering the steering system 106 based on additional operational parameters, such as the current speed, engine RPM value, throttle request extent, and/or acceleration level indicated in the current operational state of the PWC 102. To this end, the steering control data 214 may associate possible speeds, possible engine RPM values, possible throttle request extents, and/or possible acceleration levels of the PWC 102 each with a different weight value. The ECU 132 may be configured to determine the target torque for centering the steering system 106 by determining the weight value associated with the current speed, engine RPM value, throttle request extent, and/or acceleration level of the PWC 102 in the steering control data 214, and determining the target torque based on each determined weight value and a base torque as described above. The steering control data 214 may be configured such that the greater the possible value for each of the speed, engine RPM, throttle request extent, and/or acceleration level operational parameters, the greater the weight value associated with the possible value. In some instances, the ECU 132 may be configured to determine the target torque by multiplying the determined base torque by the current speed, engine RPM value, throttle request extent and/or acceleration level. Consequently, the greater the speed, engine RPM value, throttle request extent, and/or acceleration level of the PWC 102, the greater the magnitude of the target torque so as to provide fast centering while minimizing steering overshoots.

The target torque may also be configured to provide a heading assist function for the steering system 106. For instance, the current operational state of the PWC 102 may indicate a current heading of the PWC 102, and the driver may interact with a navigation system of the PWC 102 to set a desired heading of the PWC 102. The ECU 132 may be configured to determine a target torque for maintaining the set heading by determining a difference between the current heading of the PWC 102 and the set heading. The steering control data 214 may associate various possible differences between the current heading and set heading each with a different torque value for minimizing the difference. The ECU 132 may be configured to determine the target torque by determining the torque value associated with the determined difference in the steering control data 214, and using the determined torque value, which may be set as the base torque described above, as the target torque. The determined target torque may include a direction that steers the PWC 102 from the current heading to the set heading. The steering control data 214 may be configured such that the greater the possible difference, the greater the magnitude of the torque value associated with the possible difference. Consequently, the greater the possible difference, the greater the magnitude of the target torque so as to provide fast heading adjustments while minimizing steering overshoots.

Similar to the above examples, the ECU 132 may further be configured to determine the target torque for adjusting the heading of the PWC 102 based on additional operational parameters, such as the current speed, engine RPM value, throttle request extent, and/or acceleration level indicated in the current operational state of the PWC 102. To this end, the steering control data 214 may associate possible speeds, possible engine RPM values, possible throttle request extents, and/or possible acceleration levels of the PWC 102 each with a different weight value. The ECU 132 may be configured to determine the target torque for maintaining the set heading by determining the weight value associated with the current speed, engine RPM value, throttle request extent, and/or acceleration level of the PWC 102 in the steering control data 214, and determining the target torque based on each determined weight value and an base torque as described above. The steering control data 214 may be configured such that the greater the possible value for each of the speed, engine RPM, throttle request extent, and/or acceleration level operational parameters, the greater the weight value associated with the possible value. In some instances, the ECU 132 may be configured to determine the target torque by multiplying the determined base torque by the current speed, engine RPM value, throttle request extent and/or acceleration level. Consequently, the greater the speed, engine RPM value, In some instances, the ECU 132 may be configured to determine the target torque by multiplying the determined base torque by the current speed, engine RPM value, throttle request extent and/or acceleration level of the PWC 102, the greater the magnitude of the target torque so as to provide fast heading adjustments while minimizing steering overshoots.

The ECU 132 may thus be configured to determine a target torque for the enhanced steering control system 108 to apply to the steering system 106 by applying the current operational state of the PWC 102 to the steering control data 214. Additional details for determining the target torque for the enhanced steering control system 108 to apply to the steering system 106 may be found in PCT Application No. PCT/IB2019/061319 and corresponding WO Publication No. WO/2020/129033, the disclosure of which is hereby incorporated by reference herein in its entirety.

In block 308, the torque being applied to the steering system 106 by the mechanical dampers 128 may be estimated. In particular, the ECU 132 may be configured to estimate the torque force being applied to the steering system 106 by the mechanical dampers 128 based on the determined operational state of the PWC 102 and the steering control data 214. Similar to the target torque examples provided above, and as described in more detail below, the steering control data 214 may include data associating varying possible operational states with different estimated torque forces applied by the mechanical dampers 128 to the steering system 106, such as through one or more formulas and/or lookup tables defined by the steering control data 214. The ECU 132 may thus be configured to estimate the torque force being applied to the steering system 106 by the mechanical dampers 128 by applying the current operational state of the PWC 102 to the steering control data 214.

In block 310, an additional torque to apply to the steering system 106 by the EAD 130 may be determined based on the estimated torque and the target torque. The ECU 132 may be configured to determine the additional torque based on the estimated torque and the target torque by being configured to determine a difference between the estimated torque and the target torque. The ECU 132 may be configured to use this difference as the additional torque. In other words, the ECU 132 may be configured to determine an additional torque to apply to the steering system 106 that supplements the estimated torque provided by the mechanical dampers 128 so that the combination of estimated torque and the additional torque results in the target torque being applied to the steering system 106. For instance, if the estimated torque is less than and in the same direction as the target torque, then the additional torque may be in the direction of the estimated torque. If the estimated torque is greater than and in the same direction as the target torque, then the additional torque may be in the direction opposite of the estimated torque. If the estimated torque is in a direction opposite the target torque, then the additional torque may include a magnitude greater than that of the estimated torque and be in a direction opposite the estimated torque.

In block 312, the EAD 130 may be operated to apply the additional torque to the steering system 106. The ECU 132 may be configured to apply a current to the motor 136 of the EAD 130 that causes the motor 136 to apply the additional torque to the steering system 106. The ECU 132 may be configured to determine the current for the motor 136 based on the steering control data 214. The steering control data 214 may include data associating various torque forces for the steering system 106 each with a different electrical current value for the motor 136 to apply the torque force to the steering system 106, such as through one or more formulas and/or lookup tables defined by the steering control data 214. The ECU 132 may thus be configured to determine a current to apply to the motor 136 by applying the determined additional torque force to the steering control data 214.

Following block 312, the method 300 may return to block 302 and be repeated. The ECU 132 may thus be configured to perform a continuous loop during operation of the PWC 102 in which, for each iteration of the loop, the ECU 132 determines a current operational state of the PWC 102, determines a target force for the steering system 106 based on the operational state, estimates a torque being applied to the steering system 106 by the mechanical dampers 128 based on the operational state, and operates the EAD 130 to apply additional torque to the steering system 106 based on the target torque, the estimated torque, and the operational state of the PWC 102. During each iteration, the ECU 132 may also be configured to implement one or more proportional, integral, derivative (PID) algorithms to promote efficient enhanced steering control function and prevent steering overshoots.

Figure 5:
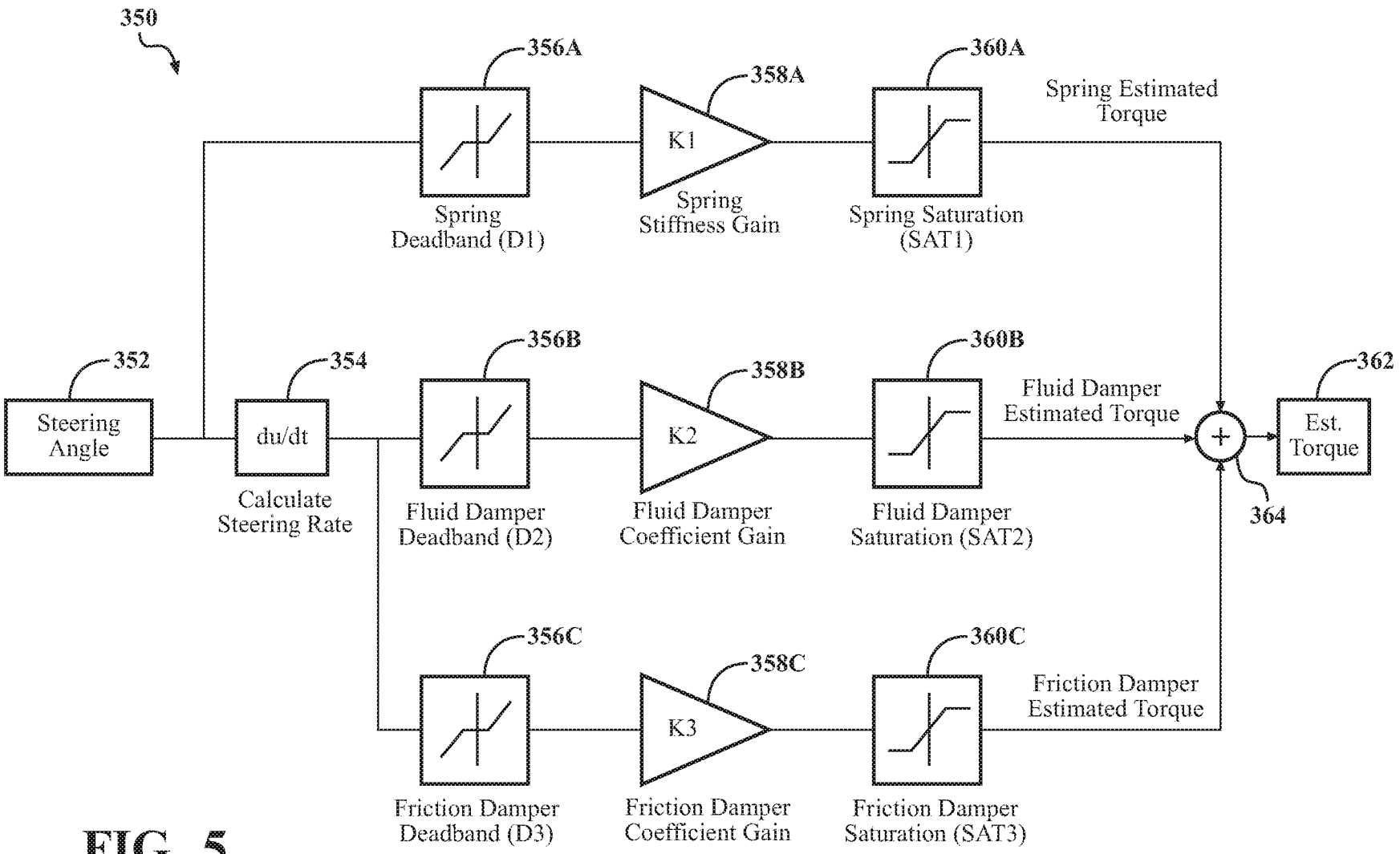
FIG. 5 is a diagram of a processing architecture for estimating an amount of force applied by mechanical dampers to a steering system of a recreational vehicle using a linear model.

FIG. 5 illustrates a linear model 350 for estimating the torque force applied to the steering system 106 by the mechanical dampers 128 based on a determined operational state of the PWC 102. The steering control data 214 may indicate the linear model 350. To perform block 308 of FIG. 4, the ECU 132 may be configured, such as via execution of the steering control application 212, to retrieve the linear model 350 from the steering control data 214, and to apply the determined operational state of the PWC 102 to the linear model 350 to estimate the torque force applied to the steering system 106 by the mechanical dampers 128.

The linear model 350 may model the torque force applied to the steering system 106 by each mechanical damper 128 as being linearly related to one or more of the operational parameters defining the current operational state of the PWC 102. For instance, the torque force applied by the spring type mechanical damper 128A to the steering system 106 may be modeled as linearly related to a steering angle 352 of the steering system 106, and the torque force applied by the fluid type mechanical damper 128B and the friction type mechanical damper 128C may be modeled as linearly related to a steering rate 354 of the steering system 106.

For each mechanical damper 128, the linear model 350 may include deadband data 356, gain data 358, and saturation data 360. The deadband data 356 may indicate when the mechanical damper 128 begins applying torque to the steering system 106 as a function of the one or more operational parameters linearly related to the mechanical damper 128. Specifically, each mechanical damper 128 may be configured to begin applying torque to the steering system 106 when the magnitude of at least one of the one or more operational parameters linearly related to the mechanical damper 128 is greater than a defined threshold. If the magnitude of all of the linearly related operational parameters are less than or equal to respectively defined thresholds, then the mechanical damper 128 may be configured to apply negligible (e.g., little or no) torque to the steering system 106. The deadband data 356 for each mechanical damper 128 may thus define a deadband threshold for each of the one or more operational parameters linearly related to the mechanical damper 128. For instance, the deadband data 356 may define a single deadband threshold for all the linearly related operational parameters, or may define a distinct deadband threshold for each of the linearly related operational parameters.

The ECU 132 may thus be configured to estimate the torque applied by each of the mechanical dampers 128 to the steering system 106 based on the linear model 350 by being configured to apply the current operational state of the PWC 102 to the deadband data 356 for the mechanical damper 128. Specifically, for each operational parameter of the determined operational state that is linearly related to the mechanical damper 128, the ECU 132 may be configured to determine whether the magnitude of the operational parameter included in the determined operational state is less than or equal to the deadband threshold for the operational parameter defined by the deadband data 356 for the mechanical damper 128. Responsive to the magnitude of the operational parameter being less than or equal to the defined deadband threshold, the ECU 132 may be configured to output a base value of zero for the operational parameter relative to the mechanical damper 128, indicating that the mechanical damper 128 is applying negligible torque to the steering system 106 as a function of the operational parameter.

Conversely, responsive to the magnitude of the operational parameter being greater than the defined deadband threshold, the ECU 132 may be configured to output a non-zero base value for the operational parameter relative to the mechanical damper 128, indicating that the mechanical damper 128 is applying non-negligible torque to the steering system 106 as a function of the operational parameter. The magnitude of the non-zero base value may be proportional to the magnitude of the operational parameter according to a generic linear response for the mechanical damper 128, which may define a slope such as one. The ECU 132 may be configured to determine the non-zero base value as equal to the difference between the magnitude of the operational parameter and the threshold defined for the operational parameter multiplied by the slope of the generic linear response.

The sign of the non-zero base value may correspond to the direction of the torque being applied by the mechanical damper 128 to the steering system 106, and may be opposite the sign of the operational parameter. For instance, if the steering angle 352 is positive, which may indicate that the steering system 106 is positioned clockwise relative to its center position, then the ECU 132 may be configured to generate a negative non-zero base value for the steering angle operational parameter, which may correspond to the mechanical damper 128 applying torque to the steering system 106 towards the center position. As a further example, if the steering rate 354 is positive, which may indicate the steering system 106 is being rotated in the clockwise direction, then the ECU 132 may be configured to generate a negative non-zero base value for the steering rate operational parameter, which may correspond to the mechanical damper 128 applying torque to the steering system 106 in a direction opposite the current movement of the steering system 106.

The ECU 132 may be configured to determine an effective base value for the mechanical damper 128 based the base values determined for each operational parameter linearly related to the mechanical damper 128. The effective base value may indicate a direction and magnitude of torque that would be estimated for a generic mechanical damper that is of the same type as the mechanical damper 128. The ECU 132 may be configured to determine the effective base value by summing the determined base values, multiplying the magnitudes of the determined based values, determining an average of the determined base values, or using the determined base value with the highest magnitude as the effective base value. The sign of the effective base value may correspond to the sign of each determined base value, and may similarly indicate the direction of the torque estimated to be applied by the mechanical damper 128. Hence, if each of the determined base values is zero, then the effective base value determined for the mechanical damper 128 may be zero, indicating that the mechanical damper 128 is overall applying negligible torque to the steering system 106. Moreover, if the mechanical damper 128 is linearly related to a single operational parameter, then the base value determined for this operational parameter may be used as the effective base value for the mechanical damper 128.

Referring still to FIG. 5 as an example, if the steering angle 352 indicates that the distance between the current angle of the steering system 106 and a center position of the steering system 106 is less than or equal to a deadband threshold defined by deadband data 356A for the spring type mechanical damper 128A, then the ECU 132 may be configured to determine an effective base value of zero for the spring type mechanical damper 128A and ultimately, as described in more detail below, an estimated torque of zero being applied by the spring type mechanical damper 128A. Alternatively, if the steering angle 352 indicates that the distance between the current angle of the steering system 106 and the center position of the steering system 106 is greater than the defined deadband threshold, then the ECU 132 may be configured to determine a non-zero effective base value for the mechanical damper 128 that is proportional to the difference according to a generic linear response, such as a slope of one.

The gain data 358 for each mechanical damper 128 may indicate a level of torque applied to the steering system 106 by the specific mechanical damper 128 as a function of the magnitude of the one or more operational parameters linearly related to the mechanical damper 128, or more particularly as a function of the effective base value for the mechanical damper 128. Depending on the configuration of the mechanical damper 128, its actual linear response may differ from the generic linear response. For instance, referring to the spring type mechanical damper 128A, the greater the stiffness of the spring type mechanical damper 128A, the more torque the spring type mechanical damper 128A may apply to the steering system 106 with each incremental increase to the steering angle 352. Accordingly, for relatively stiffer spring type mechanical dampers 128A, the gain data 358A may define a gain parameter set to a relatively high value (e.g., ten) to model a linear response with a slope ten times greater than the slope of the generic linear response previously applied.

For each mechanical damper 128, the ECU 132 may thus be configured to multiply the effective base value determined for the mechanical damper 128 by the gain parameter defined by the gain data 358 for the mechanical damper 128. If the effective base value determined from the deadband data 356 is zero, which corresponds to the mechanical damper 128 providing negligible torque to the steering system 106, then the outcome of the multiplication will similarly be zero. If the effective base value determined from the deadband data 356 is non-zero, then the outcome of the multiplication will be non-zero in accordance with the linear response set by the gain parameter defined by the gain data 358.

The saturation data 360 for each mechanical damper 128 may define a maximum torque that the mechanical damper 128 is capable of applying to the steering system 106. Each mechanical damper 128 may be limited in the amount of torque it is able to provide to the steering system 106. The saturation data 360 may indicate this maximum torque.

The ECU 132 may thus be configured to estimate the amount of torque applied to the steering system 106 by each mechanical damper 128 by being configured to apply the result of the multiplication by the gain parameter for the mechanical damper 128 to the saturation data 360 for the mechanical damper 128. Specifically, the ECU 132 may be configured to determine whether the magnitude of the result of the multiplication is greater than the maximum torque indicated by the saturation data 360. Responsive to the magnitude of the multiplication result being less than or equal to the maximum torque indicated by the saturation data 360, then the ECU 132 may be configured to estimate that the torque applied by the mechanical damper 128 to the steering system has a magnitude equal to the magnitude of the multiplication result. Responsive to the magnitude of the multiplication result being greater than the maximum torque defined by the saturation data 360, then the ECU 132 may be configured to estimate the defined maximum torque as the magnitude of torque being applied by the mechanical damper 128 to the steering system 106. The sign (i.e., direction) of the torque estimated as being applied to the steering system 106 by the mechanical damper 128 may match the sign of the effective base value and of the multiplication result.

Finally, the ECU 132 may be configured to determine an estimated torque 362 being applied to the steering system 106 by the mechanical dampers 128 based on the estimated torque being applied by each mechanical damper 128. The ECU 132 may be configured to determine the estimated torque 362 by performing a summation 364 of the estimated torque determined for each mechanical damper 128.

Figure 6:
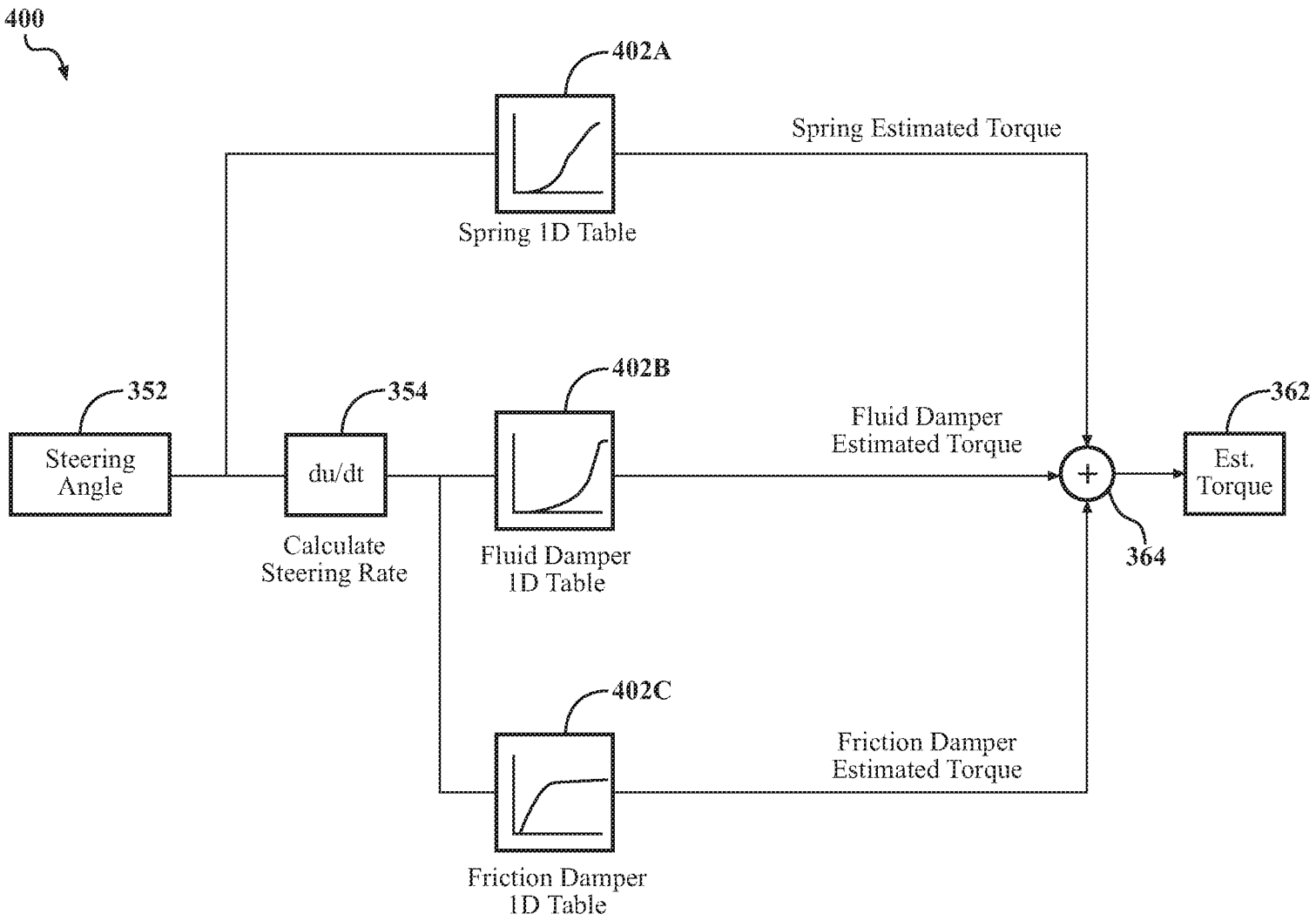
FIG. 6 is a diagram of a processing architecture for estimating an amount of force applied by mechanical dampers to a steering system of a recreational vehicle using a non-linear model.

FIG. 6 illustrates a non-linear model 400 for estimating the torque force applied to the steering system 106 by the mechanical dampers 128 based on the determined operational state of the PWC 102. The steering control data 214 may indicate the non-linear model 400. To perform block 308 of FIG. 4, the ECU 132 may be configured, such as via execution of the steering control application 212, to retrieve the non-linear model 400 from the steering control data 214, and to apply the determined operational state of the PWC 102 to the non-linear model 400 to estimate the torque applied to the steering system 106 by the mechanical dampers 128.

The amount of torque applied to the steering system 106 by each mechanical damper 128 may be a function of one or more operational parameters defining the current operational state of the PWC 102. The relationship between the operational parameters and applied torque may be non-linear. Thus, for each mechanical damper 128, the non-linear model 400 may include a one dimensional (1D) table 402 or a multi-dimensional table defining different possible parameter states each including a possible value for each of the one or more operational parameters to which the mechanical damper 128 is functionally related, and associating each possible parameter state with a corresponding torque estimated to be applied to the steering system 106 by the mechanical damper 128 when the determined operational state of the PWC 102 includes the one or more possible values of the possible parameter state. Specifically, when the response of the mechanical damper 128 is a function of one operational parameter, the non-linear model 400 may define a 1D table 402 for the mechanical damper 128. When the response of the mechanical damper 128 is a function of plural operational parameters, the non-linear model 400 may define a multi-dimensional table for the mechanical damper 128, where the number of dimensions equals the number of associated operational parameters.

For instance, referring to FIG. 6, the amount torque provided by the spring type mechanical damper 128A may be a function of the steering angle 352 of the PWC 102, and the amount of torque provided by the fluid type mechanical damper 128B and the friction type mechanical damper 128C may each be a function of the steering rate 354 of the steering system 106. Thus, the non-linear model 400 may define a 1D table 402 for each mechanical damper 128. The 1D table 402A for the spring type mechanical damper 128A may set forth various possible steering angles 352, and may associate each possible steering angle 352 with a torque applied to the steering system 106 by the spring type mechanical damper 128A when the current operational state of the PWC 102 indicates the possible steering angle 352. Similarly, the 1D tables 402B and 402C for the fluid type mechanical damper 128B and friction type mechanical damper 128C respectively may each set forth various possible steering rates 354, and may each associate each possible steering rate 354 with a torque applied to the steering system 106 by the fluid type mechanical damper 128B and friction type mechanical damper 128C respectively when the current operational state of the PWC 102 indicates the possible steering rate 354.

The ECU 132 may be configured to estimate the amount of torque applied to the steering system 106 by the mechanical dampers 128 using the non-linear model 400 by being configured to apply the determined operational state of the PWC 102 to the defined tables, such as the 1D tables 402. Specifically, the ECU 132 may be configured to estimate the amount of torque applied by each mechanical damper 128 by being configured to apply the values for the one or more operational parameters to which the mechanical damper 128 is functionally related and indicated in the current operational state of the PWC 102 to the 1D table 402 or multi-dimensional table for the mechanical damper 128 in the non-linear model 400. If the one or more applied operational parameter values matches one of the possible parameter states set forth in the table (e.g., is equivalent to or within a threshold distance, such as based on a sum of squared distances between corresponding values), then the ECU 132 may be configured to estimate that the torque associated with the matched possible parameter state in the table is being applied to the steering system 106 by the mechanical damper 128. If not, then the ECU 132 may be configured to utilize interpolation, such as linear interpolation, to estimate the torque applied to the steering system 106 by the mechanical damper 128. For instance, the ECU 132 may be configured to interpolate the estimated torque based on the two or more possible parameters states in the table that are closest to or surrounding the current operational state, which may be determined using the sum of squared distances between corresponding values.

Finally, the ECU 132 may be configured to determine an estimated torque 362 being applied to the steering system 106 by the mechanical dampers 128 based on the estimated torque being applied by each mechanical damper 128. For instance, the ECU 132 may be configured to determine the estimated torque 362 by performing a summation 364 of the estimated torque applied by each mechanical damper 128. The sign of the estimated torque 362 may correspond to the direction of the torque being applied to the steering system 106 by the mechanical dampers 128.

Figure 7:
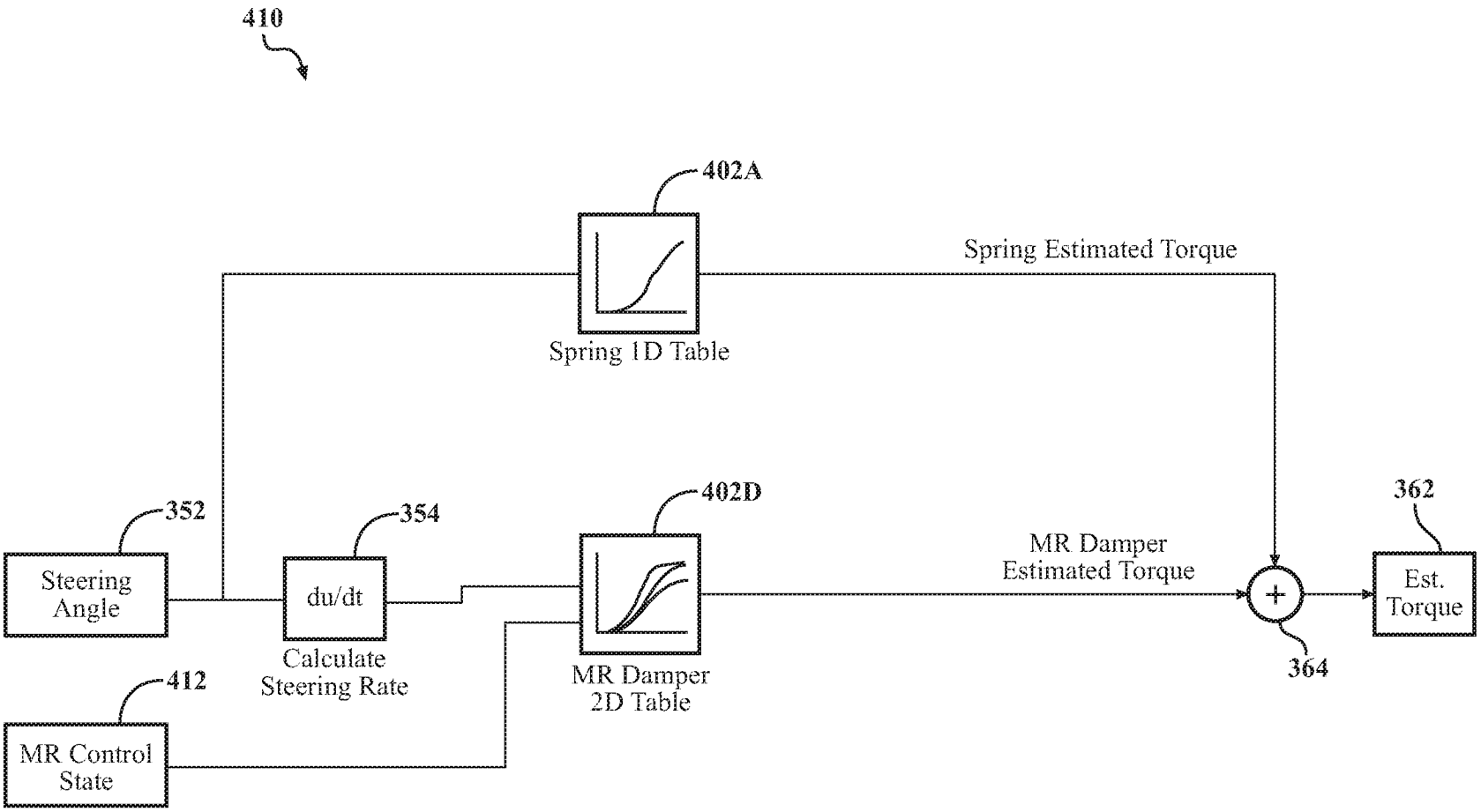
FIG. 7 is a diagram of a processing architecture for estimating an amount of force applied by mechanical dampers to a steering system of a recreational vehicle using another non-linear model.

FIG. 7 illustrates another non-linear model 410 for estimating the force applied to the steering system 106 by the mechanical dampers 128 based on the determined operational state of the PWC 102. The steering control data 214 may indicate the non-linear model 410. To perform block 308 of FIG. 4, the ECU 132 may be configured, such as via execution of the steering control application 212, to retrieve the non-linear model 410 from the steering control data 214, and to apply the determined operational state of the PWC 102 to the non-linear model 410 to estimate the torque applied to the steering system 106 by the mechanical dampers 128.

In the example of FIG. 7, the mechanical dampers 128 of the PWC 102 includes a spring type mechanical damper 128A and a fluid type mechanical damper 128B that is a MR fluid damper. The torque applied by the spring type mechanical damper 128A to the steering system 106 may be a function of the steering angle 352 of the PWC 102, and the force applied by the MR fluid type mechanical damper 128B to the steering system 106 may be a function of the steering rate 354 of the PWC 102 and an MR control state 412. The MR control state 412 may indicate the characteristics of a magnetic field being applied to the MR fluid type mechanical damper 128B, which may correspondingly indicate which of possible responses will be provided by the fluid type mechanical damper 128B as a function of the steering rate 354.

In this case, the non-linear model 410 may include a 1D table 402A for the spring type mechanical damper 128A, which is described above, and may include a two-dimensional (2D) table 402D for the MR fluid type mechanical damper 128B. The 2D table 402D may define several different possible parameter states each including a different combination of possible values for the steering rate 354 and MR control state 412, and may associate each possible parameter state with a torque estimated to be applied by the MR fluid type mechanical damper 128B when the current operational state of the PWC 102 includes the possible values of the possible parameter state. Essentially, the 2D table 402D may be considered as including several fluid 1D tables 402B (FIG. 6), each representing a possible response of the MR fluid type mechanical damper 128B as a function of the steering rate 354 depending on the current MR control state 412. In other words, each of the 1D tables 402B indicated by the 2D table 402D for the MR fluid type mechanical damper 128B may be associated with a different possible MR control state 412.

The ECU 132 may be configured to estimate the amount of torque applied to steering system 106 by the mechanical dampers 128 using the non-linear model 410 by applying the current operational state of the PWC 102 to the 1D table 402A for the spring type mechanical damper 128A and the 2D table 402D for the MR fluid type mechanical damper 128B. Specifically, the ECU 132 may be configured to estimate the amount of torque being applied by the spring type mechanical damper 128A to the steering system 106 by applying the steering angle 352 indicated by the current operational state of the PWC 102 to the 1D table 402A, and may be configured to estimate the amount of torque being applied to the steering system 106 by the MR fluid type mechanical damper 128B by applying the steering rate 354 and MR control state 412 indicated by the current operational state of the PWC 102 to the 2D table 402D. If the one or more operational parameter values applied to each table match a possible parameter state of the table (e.g., is equivalent to or within a threshold distance of a possible parameter state of the table, such as based on a sum of squared distances of corresponding values), then the ECU 132 may be configured to estimate the torque associated with the matching possible parameter state within the table as the torque being applied by the mechanical damper 128. If the one or more operational parameter values applied to a given table do not match a possible parameter state of the table, then the ECU 132 may be configured to estimate a torque provided by the mechanical damper 128 associated with the table using interpolation, such as linear interpolation for the spring 1D table 402A and bilinear interpolation for the 2D table 414.

Finally, the ECU 132 may be configured to determine an estimated torque 362 being applied to the steering system 106 by the mechanical dampers 128 based on the estimated torque being applied by each mechanical damper 128. For instance, the ECU 132 may be configured to determine the estimated torque 362 by performing a summation 364 of the estimated torque applied by each mechanical damper 128. The sign of the estimated torque 362 may correspond to the direction of the torque being applied to the steering system 106 by the mechanical dampers 128.

In some examples, a combination of linear and non-linear models may be used to model the force applied by the mechanical dampers 128 on the steering system 106 as a function of the operational state of the PWC 102. Specifically, one or more of the mechanical dampers 128 may be modeled as being linearly related to one or more operational parameters, similar to the linear model 350, and one or more of the mechanical dampers 128 may be modeled as being non-linearly related to one or more operational parameters, similar to the non-linear models 400, 410. The steering control data 214 may store the model for each of the mechanical dampers 128, whether linear or non-linear. To perform block 308 of FIG. 4, the ECU 132 may be configured, such as via execution of the steering control application 212, to retrieve the models from the steering control data 214, and to apply the relevant operational parameters of the determined operational state of the PWC 102 to each model to estimate the torque force applied to the steering system 106 by the mechanical dampers 128 associated with the model. The ECU 132 may be configured to then sum the torque force estimated for each mechanical damper 128 to determine a total estimated torque force applied to the steering system 106 by the mechanical dampers 128.

Figure 8:
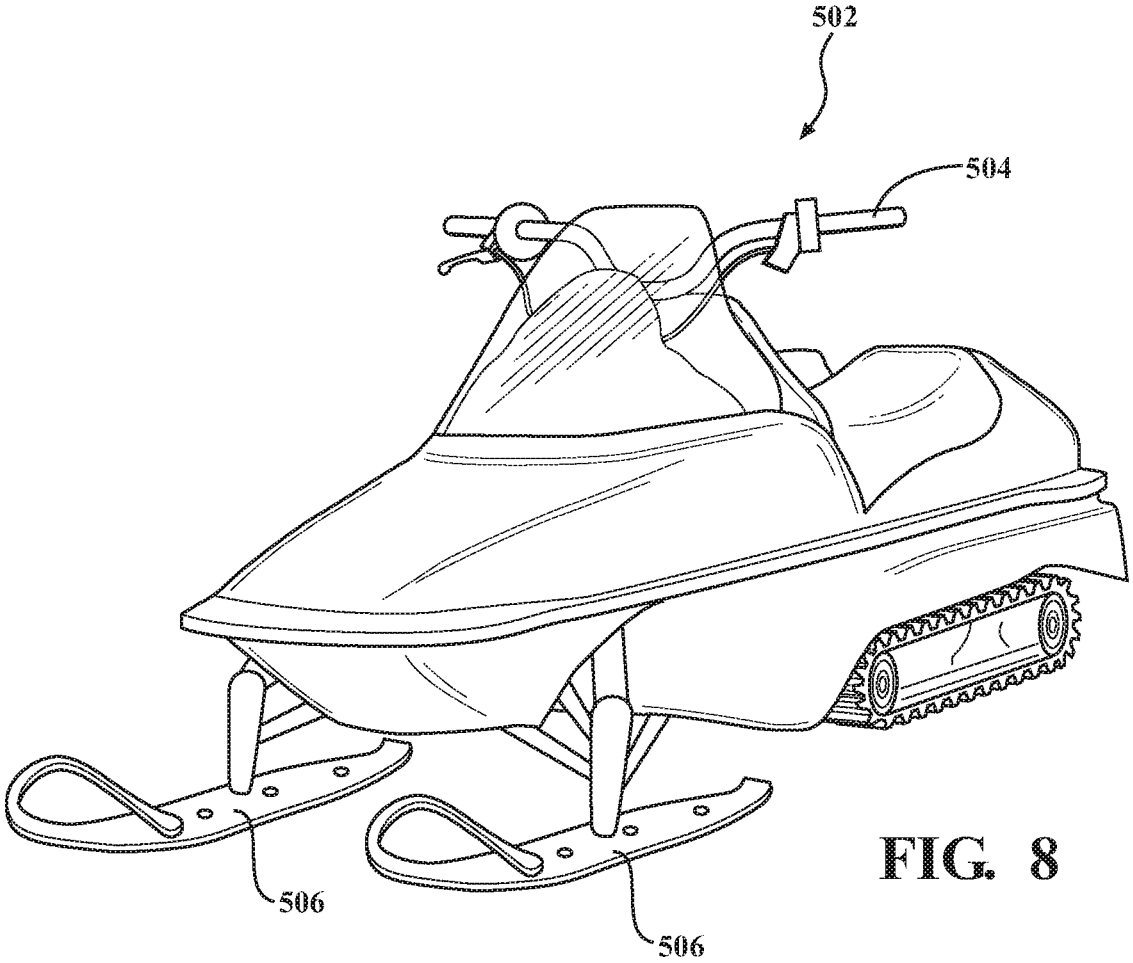
FIG. 8 is a perspective view of a snowmobile type recreational vehicle that may incorporate the enhanced steering control system of FIG. 1.

While the enhanced steering control system 108, method 300, and other features have been described above in connection with a PWC, it will be appreciated that these items may be incorporated into other recreational vehicles to provide the enhanced steering control functionality described above. For instance, FIG. 8 illustrates a snowmobile 502 including a steering handle 504 and steering skis 506, and FIG. 9 illustrates an all-terrain vehicle (ATV) 602 including a steering handle 604 and tires 606. As described in more detail below, each of these recreational vehicle types may benefit from the enhanced steering control features described herein.

FIG. 10 illustrates an exemplary steering assembly 702 that may be incorporated into a recreational vehicle such as the snowmobile 502 and ATV 602. The steering assembly 702 may include a user-operated steering element 704, a steering column 706, a steering rack 708, steering rods 710, and ground engaging members 712. The steering column 706 may be coupled to and rotatable with the user-operated steering element 704, which may be the steering handle 504 of the snowmobile 502 (FIG. 8) or the steering handle 604 of the ATV 602 (FIG. 9). The steering column 706 may also be coupled to the ground engaging members 712, which may be the steering skis 506 of the snowmobile 502 (FIG. 8) or the tires 606 of the ATV 602 (FIG. 9), such as via the steering rack 708 and the steering rods 710. Rotation of the user-operated steering element 704 may cause a corresponding rotation of the steering column 706, which may cause a corresponding movement of the steering rods 20, which in turn may cause corresponding turning of the ground engaging members 712 to steer the recreational vehicle.

According to the mechanical linkage provided by the steering assembly 702, the ground engaging members 712 may be coupled to and rotatable with the user-operated steering element 704 such that rotation of the user-operated steering element 704 causes a corresponding rotation of the ground engaging members 712 to steering the vehicle. Similarly, the user-operated steering element 704 may be coupled to and rotatable with the ground engaging members 712 such that external environmental forces (e.g., moguls, off-road driving surfaces) acting on the ground engaging members 712 may be translated to a rotation of the steering column 706 and user-operated steering element 704.

Like the steering system 106 of the PWC 102 described above, the steering assembly 702 may have a relatively small lock-to-lock range (e.g., less than ninety-degrees), which may offer very quick but low-resolution steering control when compared to the typical automobile. Moreover, relative to the automobile, each of these types of recreational vehicles may be operated over relatively harsh terrain, which may include steep and inconsistent elevations, moguls, slippery surfaces, and malleable surfaces that form tracks in various directions from the previous passage of other like vehicles. During operation of the snowmobile 502 or ATV 602, such terrain may act on the ground engaging members 712, and may correspondingly apply a torque to the steering assembly 702 that biases the vehicle in an unintended direction. The driver may reactively expend an exhaustive amount of effort to apply corrective torque to the steering assembly 702 that maintains the direction of the vehicle. The driver may also associate the difficulty of maintaining a direction of the vehicle with a lack of control, which may lead to the driver to perform dangerous maneuvers, such as oversteering at high speeds.

To alleviate these issues, the steering assembly 702 may be equipped with the enhanced steering control system 108 configured to operate as described above. Specifically, the enhanced steering control system 108 may be equipped with one or more mechanical dampers 128 that are coupled to and configured to provide resistive torque to the steering assembly 702. The resistive torque may help limit the effect of harsh terrain on the steering assembly 702, and may help prevent the driver from performing dangerous steering maneuvers.

As described above, the enhanced steering control system may further include one or more sensors 134, an ECU 132, and an EAD 130 that generates torque on the steering assembly 702 to supplement that provided by mechanical dampers 128 to provide desired enhanced steering control functionality. For instance and similar to the examples described above, based on operational parameters determined by the ECU 132 from sensor data such as the angle of the steering assembly 702, the steering rate of the steering assembly 702, the speed of the recreational vehicle, and the acceleration level of the recreational vehicle, the ECU 132 may be configured to determine a target torque for the steering assembly 702, estimate a torque being applied by the mechanical dampers 128, and operate the EAD 130 to apply additional torque to the steering assembly 702 that minimizes the difference between the target torque and actual torque on the steering assembly 702 based on the torque estimated as being applied by the mechanical dampers 128. As an example, the target torque may be configured to increase or reduce the resistive torque provided to the steering assembly 702 from that provided by the mechanical dampers 128 to prevent undesired manipulation of the steering assembly 702 based on the current operating condition of the recreational vehicle determined by the ECU 132. As a further example, the target torque may be configured to reduce the resistive torque provided to the steering assembly 702 from that provided by the mechanical dampers 128 so as to assist the driver in rotating the user-operating steering element 704 when the current operational state indicates that the driver is attempting to turn the vehicle, which may be derived from the sensor data generated by the torque sensor.

The lack of steering feedback and relatively quick low resolution steering control provided by a recreational vehicle such as a typical PWC may lead an unexperienced driver to perform dangerous maneuvers, such as excessive steering operations at high speeds that eject the driver from the PWC. A PWC 102 with enhanced steering control for providing increased steering feedback to a driver is therefore described herein. The enhanced steering control may utilize a combination of mechanical dampers 128 and an EAD 130 each configured to apply torque to the steering system of the PWC 102 that provides increased steering feedback to the driver. Utilizing both the EAD 130 with the mechanical dampers 128 to provide the enhanced steering control enables the PWC 102 to provide dynamic steering feedback based on the current operational state of the PWC 102 while reducing the size of the EAD 130 and the electrical load required to provide the desired steering feedback. The enhanced steering control systems and methods described herein may also benefit other recreational vehicle types, such as a snowmobile 502 or ATV 602, which may incorporate the enhanced steering control systems and methods to provide the driver with improved steering control functionality.

In general, the routines executed to implement the embodiments of the invention, whether implemented as part of an operating system or a specific application, component, program, object, module or sequence of instructions, or even a subset thereof, may be referred to herein as "computer program code," or simply "program code." Program code typically comprises computer readable instructions that are resident at various times in various memory and storage devices in a computer and that, when read and executed by one or more processors in a computer, cause that computer to perform the operations necessary to execute operations and/or elements embodying the various aspects of the embodiments of the invention. Computer readable program instructions for carrying out operations of the embodiments of the invention may be, for example, assembly language or either source code or object code written in any combination of one or more programming languages.

The program code embodied in any of the applications/modules described herein is capable of being individually or collectively distributed as a program product in a variety of different forms. In particular, the program code may be distributed using a computer readable storage medium having computer readable program instructions thereon for causing a processor to carry out aspects of the embodiments of the invention.

Computer readable storage media, which is inherently non-transitory, may include volatile and non-volatile, and removable and non-removable tangible media implemented in any method or technology for storage of information, such as computer-readable instructions, data structures, program modules, or other data. Computer readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired information and which can be read by a computer. A computer readable storage medium should not be construed as transitory signals per se (e.g., radio waves or other propagating electromagnetic waves, electromagnetic waves propagating through a transmission media such as a waveguide, or electrical signals transmitted through a wire). Computer readable program instructions may be downloaded to a computer, another type of programmable data processing apparatus, or another device from a computer readable storage medium or to an external computer or external storage device via a network.

Computer readable program instructions stored in a computer readable medium may be used to direct a computer, other types of programmable data processing apparatus, or other devices to function in a particular manner, such that the instructions stored in the computer readable medium produce an article of manufacture including instructions that implement the functions/acts specified in the flowcharts, sequence diagrams, and/or block diagrams. The computer program instructions may be provided to one or more processors of a general purpose computer, special purpose computer, or other programmable data processing apparatus to produce a machine, such that the instructions, which execute via the one or more processors, cause a series of computations to be performed to implement the functions and/or acts specified in the flowcharts, sequence diagrams, and/or block diagrams.

In certain alternative embodiments, the functions and/or acts specified in the flowcharts, sequence diagrams, and/or block diagrams may be re-ordered, processed serially, and/or processed concurrently without departing from the scope of the invention. Moreover, any of the flowcharts, sequence diagrams, and/or block diagrams may include more or fewer blocks than those illustrated consistent with embodiments of the invention.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While all of the invention has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A personal watercraft comprising:

a jet powered propulsion system;

a steering system including a steering handle coupled to the jet powered propulsion system for turning the personal watercraft;

one or more mechanical dampers coupled to the steering system that resist rotation of the steering system; and an enhanced steering control system coupled to the steering system and comprising:

an electrically actuated device coupled to the steering system for applying torque to the steering system;

a sensor positioned adjacent the steering system that generates data indicating an operational state of the personal watercraft; and a controller coupled to the electrically actuated device and the sensor and configured to:

estimate a first torque applied to the steering system by the one or more mechanical dampers based on the operational state of the personal watercraft indicated by the sensor data;

calculate a second torque to apply to the steering system by the electrically actuated device based on the estimated first torque and the operational state of the personal watercraft indicated by the sensor data; and operate the electrically actuated device to apply the second torque to the steering system.

2. The personal watercraft of claim 1, wherein the controller is configured to estimate the first torque applied to the steering system by the one or more mechanical dampers based on the operational state of the personal watercraft indicated by the sensor data by being configured to:

apply the operational state to a model specific to each of the one or more mechanical dampers to determine a third torque applied to the steering system by the mechanical damper; and estimate the first torque applied to the steering system by the one or more mechanical dampers based on the third torque estimated for each of the one or more mechanical dampers.

3. The personal watercraft of claim 2, wherein the one or more mechanical dampers includes a first mechanical damper and a second mechanical damper, the operational state of the personal watercraft indicated by the sensor data includes a first operational parameter value and a second operational parameter value, and the controller is configured to apply the operational state to a model specific to each of the one or more mechanical dampers by being configured to:

apply the first and not the second operational parameter value to the model specific to the first mechanical damper; and apply the second and not the first operational parameter value to the model specific to the second mechanical damper.

4. The personal watercraft of claim 3, wherein the first operational parameter value indicates an angle of the steering system, the second operational parameter value indicates a steering rate of the steering system, the first mechanical damper is a spring type mechanical damper, and the second mechanical damper is a fluid type mechanical damper or a friction type mechanical damper.

5. The personal watercraft of claim 2, wherein the model specific to each of the one or more mechanical dampers includes deadband data, a gain parameter, and saturation data for the mechanical damper, and the controller is configured to apply the operational state to a model specific to each of the one or more mechanical dampers to determine a third torque applied to the steering system by the mechanical damper by being configured to:

generate a first value for the mechanical damper based on the deadband data for the mechanical damper and the operational state;

generate a second value for the mechanical damper by multiplying the first value for the mechanical damper by the gain parameter for the mechanical damper; and determine the third torque applied to the steering system by the mechanical damper based on the second value for the mechanical damper and the saturation data for the mechanical damper.

6. The personal watercraft of claim 3, wherein the operational state of the personal watercraft indicated by the sensor data comprises an operational parameter value, the deadband data for the mechanical damper includes a deadband threshold, and the controller is configured to generate a first value for the mechanical damper based on the deadband data for the mechanical damper and the operational state by being configured to:

determine whether the operational parameter value is greater than the deadband threshold;

generate zero as the first value for the mechanical damper responsive to the operational parameter value being less than or equal to the deadband threshold; and generate a non-zero value as the first value responsive to the operational parameter value being greater than the deadband threshold, the non-zero value being proportional to a difference between the operational parameter value and the deadband threshold according to a generic linear response.

7. The personal watercraft of claim 5, wherein the saturation data for the mechanical damper defines a maximum torque, and the controller is configured to determine the third torque applied to the steering system by the mechanical damper based on the second value for the mechanical damper and the saturation data for the mechanical damper by being configured to:

determine whether the second value for the mechanical damper is less than the maximum torque defined by the saturation data for the mechanical damper;

set the second value for the mechanical damper as the third torque applied to the steering system by the mechanical damper responsive to the second value for the mechanical damper being less than the maximum torque defined by the saturation data for the mechanical damper; and set the maximum torque defined by the saturation data for the mechanical damper as the third torque applied to the steering system by the mechanical damper responsive to the second value for the mechanical damper being greater than the maximum torque defined by the saturation data for the mechanical damper.

8. An enhanced steering control system for a steering system of a personal watercraft including a jet powered propulsion system with a steering handle of the steering system being coupled to the jet powered propulsion system to turn the personal watercraft, and the personal watercraft including one or more mechanical dampers coupled to the steering system that resist movement of the steering system, the enhanced steering control system comprising:

an electrically actuated device adapted to be coupled to the steering system of the personal watercraft for applying force to the steering system;

a sensor adapted to be positioned adjacent the steering system when the electrically actuated device is coupled to the steering system that generates data indicating an operational state of the personal watercraft; and a controller coupled to the electrically actuated device and the sensor and configured to:

estimate a first torque applied to the steering system by the one or more mechanical dampers based on the operational state of the personal watercraft indicated by the sensor data;

calculate a second torque to apply to the steering system by the electrically actuated device based on the estimated first torque and the operational state of the personal watercraft indicated by the sensor data; and operate the electrically actuated device to apply the second torque to the steering system of the personal watercraft.

9. The enhanced steering control system of claim 8, further comprising a housing that encompasses the electrically actuated device, sensor, and controller.

10. The enhanced steering control system of claim 9, wherein the housing further encompasses the one or more mechanical dampers.

11. The enhanced steering control system of claim 8, wherein the controller is configured to estimate the first torque applied to the steering system by the one or more mechanical dampers based on the operational state of the personal watercraft indicated by the sensor data by being configured to:

apply the operational state to a model specific to each of the one or more mechanical dampers to determine a third torque applied to the steering system by the mechanical damper; and estimate the first torque applied to the steering system by the one or more mechanical dampers based on the third torque estimated for each of the one or more mechanical dampers.

12. The enhanced steering control system of claim 11, wherein the one or more mechanical dampers includes a first mechanical damper and a second mechanical damper, the operational state of the personal watercraft indicated by the sensor data includes a first operational parameter value and a second operational parameter value, and the controller is configured to apply the operational state to a model specific to each of the one or more mechanical dampers by being configured to:

apply the first and not the second operational parameter value to the model specific to the first mechanical damper; and apply the second and not the first operational parameter value to the model specific to the second mechanical damper.

13. The enhanced steering control system of claim 12, wherein the first operational parameter value indicates an angle of the steering system, the second operational parameter value indicates a steering rate of the steering system, the first mechanical damper is a spring type mechanical damper, and the second mechanical damper is a fluid type mechanical damper or a friction type mechanical damper.

14. The enhanced steering control system of claim 11, wherein the model specific to each of the one or more mechanical dampers includes deadband data, a gain parameter, and saturation data for the mechanical damper, and the controller is configured to apply the operational state to a model specific to each of the one or more mechanical dampers to determine a third torque applied to the steering system by the mechanical damper by being configured to:

generate a first value for the mechanical damper based on the deadband data for the mechanical damper and the operational state;

generate a second value for the mechanical damper by multiplying the first value for the mechanical damper by the gain parameter for the mechanical damper; and determine the third torque applied to the steering system by the mechanical damper based on the second value for the mechanical damper and the saturation data for the mechanical damper.

15. The enhanced steering control system of claim 14, wherein the operational state of the personal watercraft indicated by the sensor data comprises an operational parameter value, the deadband data for the mechanical damper includes a deadband threshold, and the controller is configured to generate a first value for the mechanical damper based on the deadband data for the mechanical damper and the operational state by being configured to:

determine whether the operational parameter value is greater than the deadband threshold;

generate zero as the first value for the mechanical damper responsive to the operational parameter value being less than or equal to the deadband threshold; and generate a non-zero value as the first value responsive to the operational parameter value being greater than the deadband threshold, the non-zero value being proportional to a difference between the operational parameter value and the deadband threshold according to a generic linear response.

16. The enhanced steering control system of claim 15, wherein the generic linear response defines a slope of one.

17. The enhanced steering control system of claim 14, wherein the saturation data for the mechanical damper defines a maximum torque, and the controller is configured to determine the third torque applied to the steering system by the mechanical damper based on the second value for the mechanical damper and the saturation data for the mechanical damper by being configured to:

determine whether the second value for the mechanical damper is less than the maximum torque defined by the saturation data for the mechanical damper;

set the second value for the mechanical damper as the third torque applied to the steering system by the mechanical damper responsive to the second value for the mechanical damper being less than the maximum torque defined by the saturation data for the mechanical damper; and set the maximum torque defined by the saturation data for the mechanical damper as the third torque applied to the steering system by the mechanical damper responsive to the second value for the mechanical damper being greater than the maximum torque defined by the saturation data for the mechanical damper.

18. The enhanced steering control system of claim 8, wherein the model specific to each of the one or more mechanical dampers comprises a table associating possible parameter states each with a corresponding torque, and the controller is configured to apply the operational state to a model specific to each of the one or more mechanical dampers to determine a third torque applied to the steering system by the mechanical damper by being configured to interpolate the third torque from the table of the model specific to the mechanical damper based on the operational state.

19. The enhanced steering control system of claim 8, wherein the controller is configured to calculate a second torque to apply to the steering system based on the estimated first torque and the operational state of the personal watercraft indicated by the sensor data by being configured to:

determine a third torque to apply to the steering system based on the operational state; and calculate the second torque based on a difference between the third torque and the second torque.

20. A method for enhancing steering of a personal watercraft including a jet powered propulsion system, a steering system having a steering handle coupled to the jet powered propulsion system for turning the personal watercraft, one or more mechanical dampers coupled to and that resist movement of the steering system, an electrically actuated device coupled to the steering system for applying torque to the steering system, and a sensor positioned adjacent the steering system that generates data indicating an operational state of the personal watercraft, the method comprising the steps of:

rotating the steering handle to a apply a corresponding force on the jet powered propulsion system;

responsive to the rotation of the steering handle, estimating a first torque applied to the steering system of the personal watercraft by the one or more mechanical dampers based on the operational state of the personal watercraft indicated by the sensor data;

calculating a second torque to apply to the steering system of the personal watercraft by the electrically actuated device based on the estimated first torque and the operational state of the personal watercraft indicated by the sensor data; and operating the electrically actuated device to apply the second torque to the steering system of the personal watercraft.

* * * * *